US007649435B2

(12) United States Patent
Moriai et al.

(10) Patent No.: US 7,649,435 B2
(45) Date of Patent: Jan. 19, 2010

(54) MULTILAYER CHIP VARISTOR

(75) Inventors: Katsunari Moriai, Nikaho (JP); Dai Matsuoka, Nikaho (JP); Yo Saito, Yurihonjo (JP)

(73) Assignee: TDK Corporation, Tokyo (JP)

( * ) Notice: Subject to any disclaimer, the term of this patent is extended or adjusted under 35 U.S.C. 154(b) by 535 days.

(21) Appl. No.: 11/390,107

(22) Filed: Mar. 28, 2006

(65) Prior Publication Data

US 2006/0250211 A1 Nov. 9, 2006

(30) Foreign Application Priority Data

Apr. 14, 2005 (JP) ..... P2005-117430

(51) Int. Cl.
*H01C 7/10* (2006.01)

(52) U.S. Cl. ..... 338/21

(58) Field of Classification Search ..... 338/21
See application file for complete search history.

(56) References Cited

FOREIGN PATENT DOCUMENTS

| | | |
|---|---|---|
| JP | A-05-166672 | 7/1993 |
| JP | A 6-120007 | 4/1994 |
| JP | A-2001-307910 | 11/2001 |
| JP | A-2002-057066 | 2/2002 |
| JP | A 2002-246207 | 8/2002 |

*Primary Examiner*—Elvin G Enad
*Assistant Examiner*—Joselito Baisa
(74) *Attorney, Agent, or Firm*—Oliff & Berridge, PLC

(57) ABSTRACT

A multilayer chip varistor comprises a multilayer body in which a plurality of varistor portions are arranged along a predetermined direction, and a plurality of terminal electrodes. Each varistor portion has a varistor layer to exhibit nonlinear voltage-current characteristics, and a plurality of internal electrodes disposed so as to interpose the varistor layer between them. Each terminal electrode is disposed on a first outer surface parallel to the predetermined direction out of outer surfaces of the multilayer body and is electrically connected to a corresponding internal electrode out of the plurality of internal electrodes. Each of the plurality of internal electrodes includes a first electrode portion overlapping with another first electrode portion between adjacent internal electrodes out of the plurality of internal electrodes, and a second electrode portion led from the first electrode portion so as to be exposed in the first outer surface. The plurality of terminal electrodes are electrically connected via the respective second electrode portions to the corresponding internal electrodes.

13 Claims, 18 Drawing Sheets

MULTILAYER CHIP VARISTOR

BACKGROUND OF THE INVENTION

1. Field of the Invention

The present invention relates to a multilayer chip varistor.

2. Related Background Art

One of the known multilayer chip varistors of this type is a varistor comprising: a varistor element body having a varistor layer to exhibit nonlinear voltage-current characteristics, and a pair of internal electrodes disposed so as to interpose the varistor layer between them; and a pair of terminal electrodes which are located at two end portions of the varistor element body and each of which is connected to a corresponding internal electrode out of the internal electrodes.

SUMMARY OF THE INVENTION

In recent years, the multilayer chip varistors are used as anti-ESD (Electrostatic Discharge) components, in order to protect ICs and others included in various electric circuits in electronic devices such as DSC (Digital Still Camera), DVC (Digital Video Camera), PDA (Personal Digital Assistant), notebook computers, or cell phones from ESD. The multilayer chip varistors are used, for example, in LCD panels, button switches, battery terminals, video I/O terminals, audio I/O terminals, headphone terminals, keyboard terminals, microphones, and so on.

Incidentally, the button switches can be subject to static electricity upon contact with a human body, and it is thus necessary to use a multilayer chip varistor for each button switch. At the I/O terminals, it is necessary to use a multilayer chip varistor for each signal line, in order to achieve anti-ESD in each signal line. As in these examples, a plurality of multilayer chip varistors are mounted, depending upon locations of use.

However, where the plurality of multilayer chip varistors are mounted, the mounting area of the multilayer chip varistors becomes so large as to hinder downsizing of the aforementioned electronic devices. Since the plurality of multilayer chip varistors need to be mounted, mounting cost becomes high and mounting steps become complicated.

An object of the present invention is to provide a multilayer chip varistor permitting a reduction of mounting area, a decrease of mounting cost, and easy mounting.

A multilayer chip varistor according to the present invention is a multilayer chip varistor comprising: a multilayer body in which a plurality of varistor portions are arranged along a predetermined direction, each of the varistor portions having a varistor layer to exhibit nonlinear voltage-current characteristics and a plurality of internal electrodes disposed so as to interpose the varistor layer between the internal electrodes; and a plurality of terminal electrodes disposed on a first outer surface of the multilayer body, wherein the first outer surface extends in a direction parallel to the predetermined direction, wherein each of the plurality of internal electrodes comprises: a first electrode portion overlapping with another first electrode portion between adjacent internal electrodes out of the plurality of internal electrodes; and a second electrode portion led from the first electrode portion so as to be exposed in the first outer surface, and wherein each of the plurality of terminal electrodes is electrically connected via the second electrode portion to a corresponding internal electrode out of the plurality of internal electrodes.

In the multilayer chip varistor according to the present invention, the multilayer body comprises the plurality of varistor portions, and the plurality of terminal electrodes are disposed on the first outer surface parallel to the predetermined direction. The plurality of terminal electrodes are electrically connected via the respective second electrode portions to the corresponding internal electrodes. Therefore, the plurality of varistor portions are mounted on an external substrate when the multilayer chip varistor is mounted in a state in which the first outer surface faces the external substrate or the like. This can reduce the mounting area in mounting the plurality of varistor portions. In addition, it is feasible to achieve easy mounting, while reducing the mounting cost for mounting the plurality of varistor portions.

Preferably, the multilayer chip varistor further comprises a plurality of pad electrodes disposed on a second outer surface of the multilayer body facing the first outer surface; the second electrode portion of one internal electrode out of the adjacent internal electrodes is led so as to be exposed in the second outer surface; each of the plurality of pad electrodes is electrically connected via the second electrode portion to the one internal electrode corresponding thereto. In this case, another electric circuit element, device, or the like can be readily mounted on the second outer surface of the multilayer body.

Preferably, the multilayer chip varistor further comprises a resistor disposed on the second outer surface and electrically connected to a pair of pad electrodes out of the plurality of pad electrodes. In this case, the resistor can be readily mounted by use of the second outer surface of the multilayer body. This permits the multilayer chip varistor to be utilized as a composite component.

Preferably, the multilayer body is of a plate shape having the first outer surface and the second outer surface as principal surfaces, and a distance between the first outer surface and the second outer surface is smaller than a length of the multilayer body in the predetermined direction. In this case, the multilayer chip varistor can be constructed in a low profile.

Preferably, the predetermined direction is a laminate direction of the varistor layers. Preferably, the predetermined direction is a direction parallel to the varistor layers.

Preferably, the plurality of terminal electrodes are two-dimensionally arrayed on the first outer surface.

Preferably, the second electrode portion is linearly led from the first electrode portion. In this case, the length of the second electrode portion is relatively short, so as to enable reduction in equivalent series resistance (ESR) and equivalent series inductance (ESL).

Preferably, the second electrode portion comprises: a first region extending from the first electrode portion in a direction normal to a facing direction of the first outer surface and the second outer surface of the multilayer body facing the first outer surface and normal to the laminate direction of the varistor layers; and a second region extending from the first region in the facing direction of the first outer surface and the second outer surface; a length of the second region in the direction normal to the facing direction of the first outer surface and the second outer surface and normal to the laminate direction of the varistor layers is larger than a length of the first region in the facing direction of the first outer surface and the second outer surface. In this case, it is feasible to reduce ESR and ESL.

Incidentally, the Inventors conducted elaborate research on varistors capable of achieving an improvement in bonding strength between the varistor layers (multilayer body) consisting primarily of ZnO, and the terminal electrodes. As a result of the research, the Inventors found the new fact that the bonding strength between the varistor layers (multilayer body) and the terminal electrodes varies according to materials included in the varistor layers (a green body to become the varistor layers after fired) and the terminal electrodes (an electroconductive paste to become the terminal electrodes after fired).

The electroconductive paste is applied onto the outer surface of the green body consisting primarily of ZnO and thereafter they are fired to obtain the multilayer body and the terminal electrodes. At this time, the bonding strength between the multilayer body and the terminal electrodes obtained is improved if the green body contains a rare-earth metal (e.g., Pr (praseodymium) or the like) and if the electroconductive paste contains Pd (palladium).

The effect of the improvement in the bonding strength between the varistor layers (multilayer body) and the terminal electrodes is considered to arise from the following phenomenon during the firing. During firing the green body and electroconductive paste, the rare-earth metal in the green body migrates to near the surface of the green body, i.e., to near the interface between the green body and the electroconductive paste. Then the rare-earth metal coming to near the interface between the green body and the electroconductive paste, and Pd in the electroconductive paste counter-diffuse. At this time, a compound of the rare-earth metal and Pd can be formed near interfaces between the varistor layers (multilayer body) and the terminal electrodes. The compound of the rare-earth metal and PD offers an anchor effect to achieve an improvement in the bonding strength between the varistor layers (multilayer body) and the terminal electrodes obtained by the firing.

In light of the above fact, preferably, the varistor layer comprises ZnO as a principal component, and a rare-earth metal, and each of the plurality of terminal electrodes has an electrode layer formed on the first outer surface by simultaneous firing with the varistor layer, and comprising Pd.

In this case, the varistor layer comprises the rare-earth metal. Each of the plurality of terminal electrodes has the electrode layer formed on the first outer surface by simultaneous firing with the varistor layer, and comprising Pd. The simultaneous firing of the electrode layer with the varistor layer results in forming a compound of the rare-earth metal and Pd near the interface between the varistor layer and each terminal electrode, and the compound exists in the neighborhood of the interface. This can achieve an improvement in bonding strength between the multilayer body and each terminal electrode.

Preferably, the varistor layer comprises ZnO as a principal component, and a rare-earth metal, each of the plurality of terminal electrodes has an electrode layer disposed on the first outer surface and comprising Pd, and a compound of the rare-earth metal in the varistor layer and Pd in the electrode layer exists near an interface between the multilayer body and each terminal electrode.

In this case, since the compound of the rare-earth metal in the varistor layer and Pd in the electrode layer exists in the neighborhood of the interface between the varistor layer and each terminal electrode, an improvement can be achieved in the bonding strength between the multilayer body and each terminal electrode.

Preferably, the electrode layer is formed on the first outer surface by simultaneous firing with the varistor layer. In this case, the compound of the rare-earth metal in the varistor layer and Pd in the electrode layer can be securely made to exist in the neighborhood of the interface between the multilayer body and each terminal electrode.

Preferably, the rare-earth element in the varistor layer is Pr. In this case, the simultaneous firing of the electrode layer with the varistor layer results in forming an oxide of Pr and Pd, e.g., $Pr_2Pd_2O_5$ or $Pr_4PdO_7$ or the like near the interface between the multilayer body and each terminal electrode, and the oxide exists in the neighborhood of the interface. This can achieve an improvement in the bonding strength between the multilayer body and each terminal electrode.

Another multilayer chip varistor according to the present invention is a multilayer chip varistor comprising: a multilayer body in which a plurality of varistor layers to exhibit nonlinear voltage-current characteristics are laminated; and a plurality of terminal electrodes disposed on a first outer surface of the multilayer body, wherein the first outer surface extends in a direction parallel to a laminate direction of the plurality of varistor layers, wherein in the multilayer body, a plurality of varistor portions, each having the varistor layer and a plurality of internal electrodes disposed so as to interpose the varistor layer between the internal electrodes, are arranged along a direction parallel to the first outer surface, wherein each of the plurality of internal electrodes comprises: a first electrode portion overlapping with another first electrode portion between adjacent internal electrodes out of the plurality of internal electrodes; and a second electrode portion led from the first electrode portion so as to be exposed in the first outer surface, and wherein each of the plurality of terminal electrodes is electrically connected via the second electrode portion to a corresponding internal electrode out of the plurality of internal electrodes.

In the multilayer chip varistor according to the present invention, the plurality of varistor portions are also mounted on an external substrate when the multilayer chip varistor is mounted in a state in which the first outer surface faces the external substrate or the like. As a result, the mounting area can be reduced in mounting the plurality of varistor portions. It is also feasible to achieve easy mounting, while reducing the mounting cost for mounting the plurality of varistor portions.

The present invention successfully provides the multilayer chip varistor capable of achieving a reduction in the mounting area and achieving easy mounting, while reducing the mounting cost.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Preferred embodiments of the present invention will be described below in detail with reference to the accompanying drawings. In the description identical elements or elements with identical functionality will be denoted by the same reference symbols, without redundant description.

First Embodiment

Figure 1:
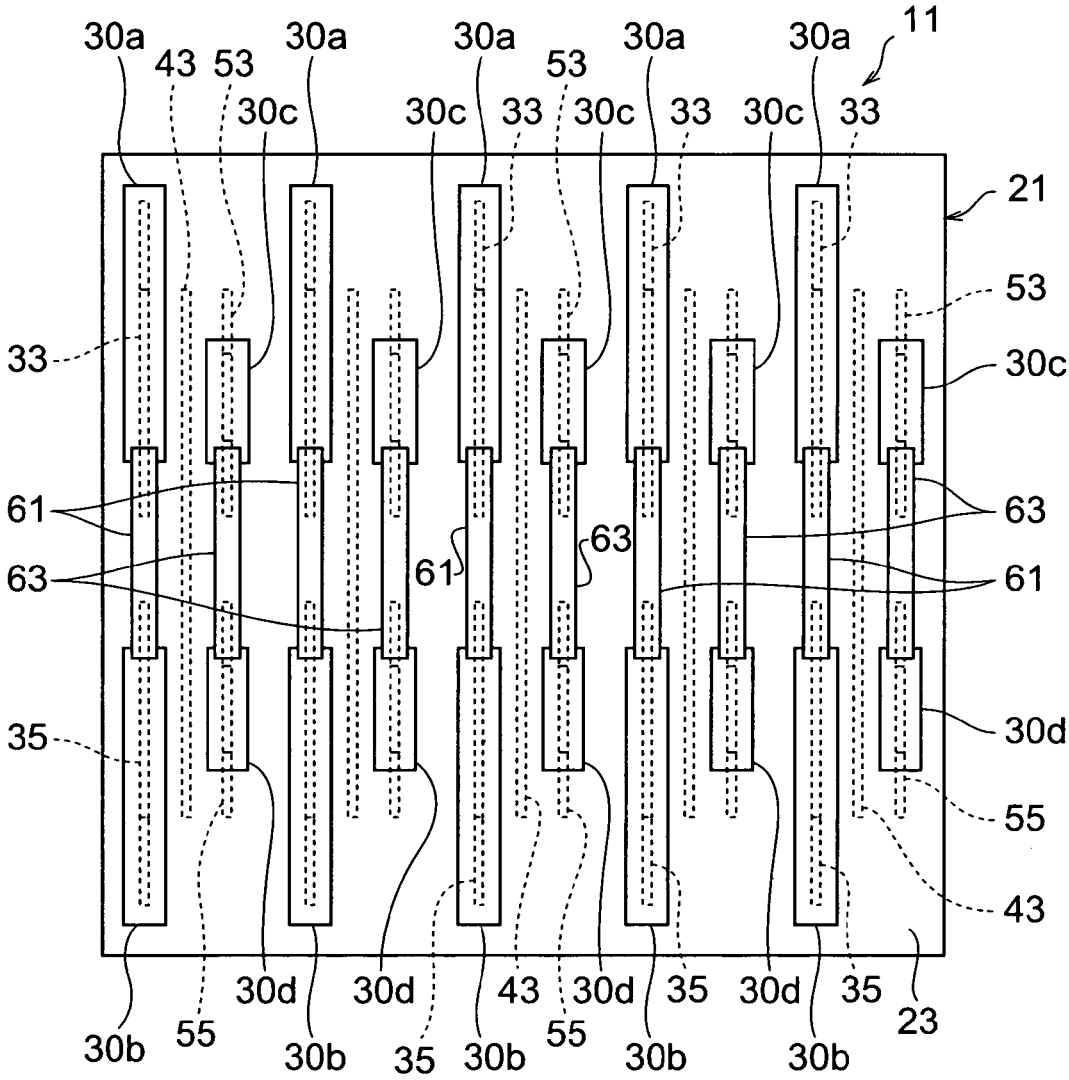
FIG. 1 is a schematic top view showing a multilayer chip varistor according to the first embodiment.
Figure 2:
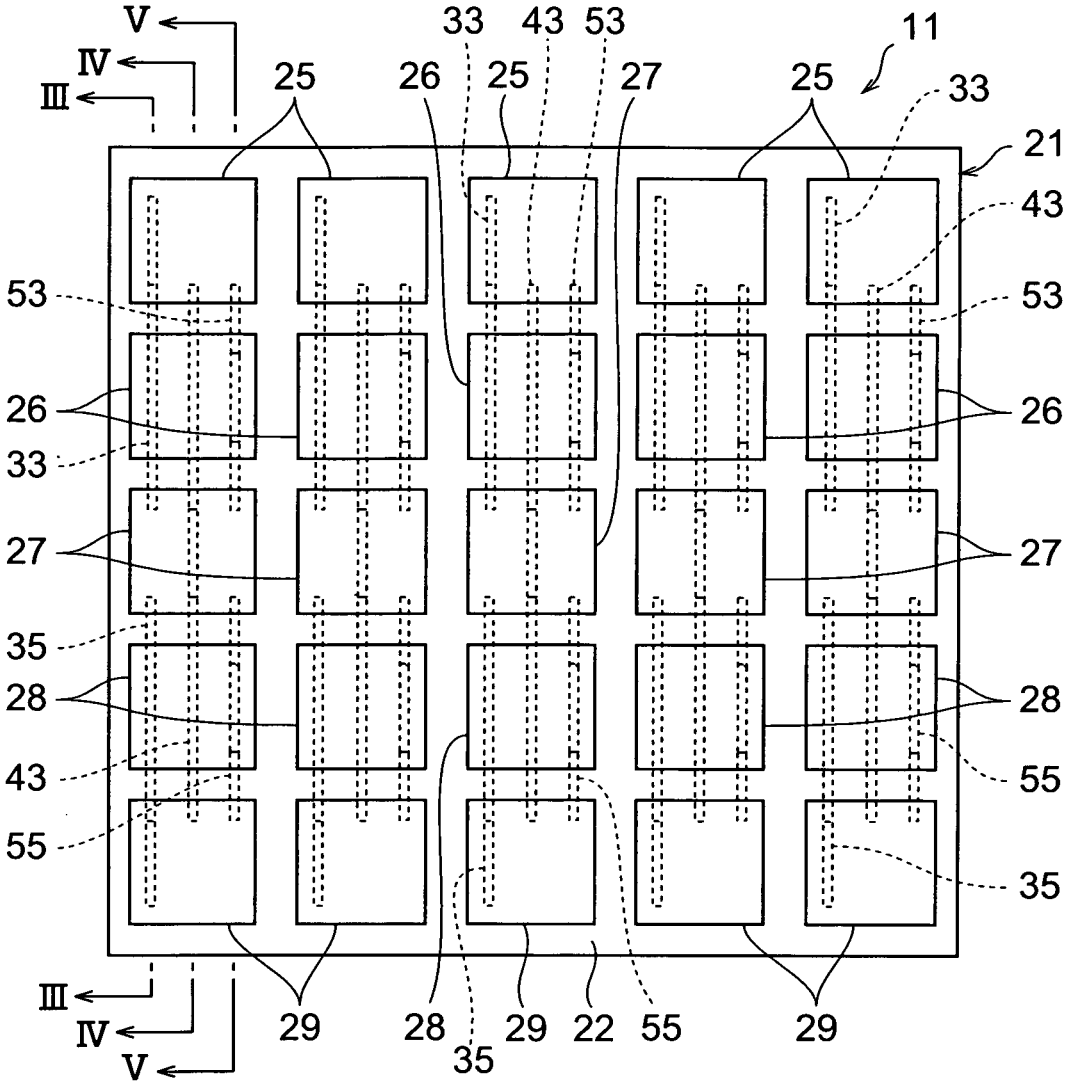
FIG. 2 is a schematic bottom view showing the multilayer chip varistor according to the first embodiment.
Figure 3:
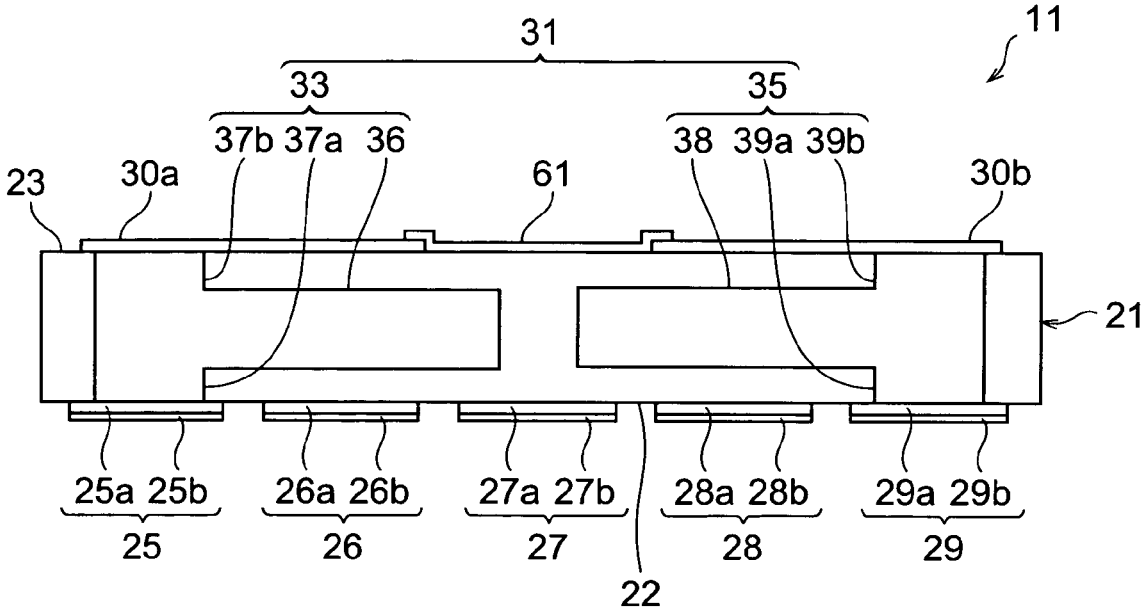
FIG. 3 is a view for explaining a sectional configuration along line III-III in FIG. 2.
Figure 4:
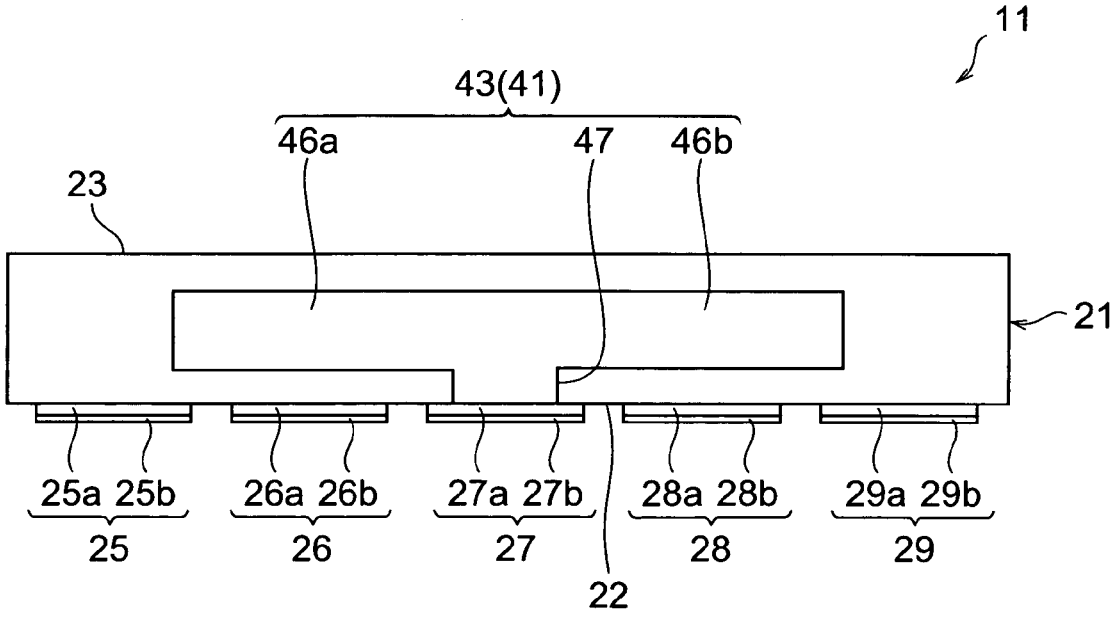
FIG. 4 is a view for explaining a sectional configuration along line IV-IV in FIG. 2.
Figure 5:
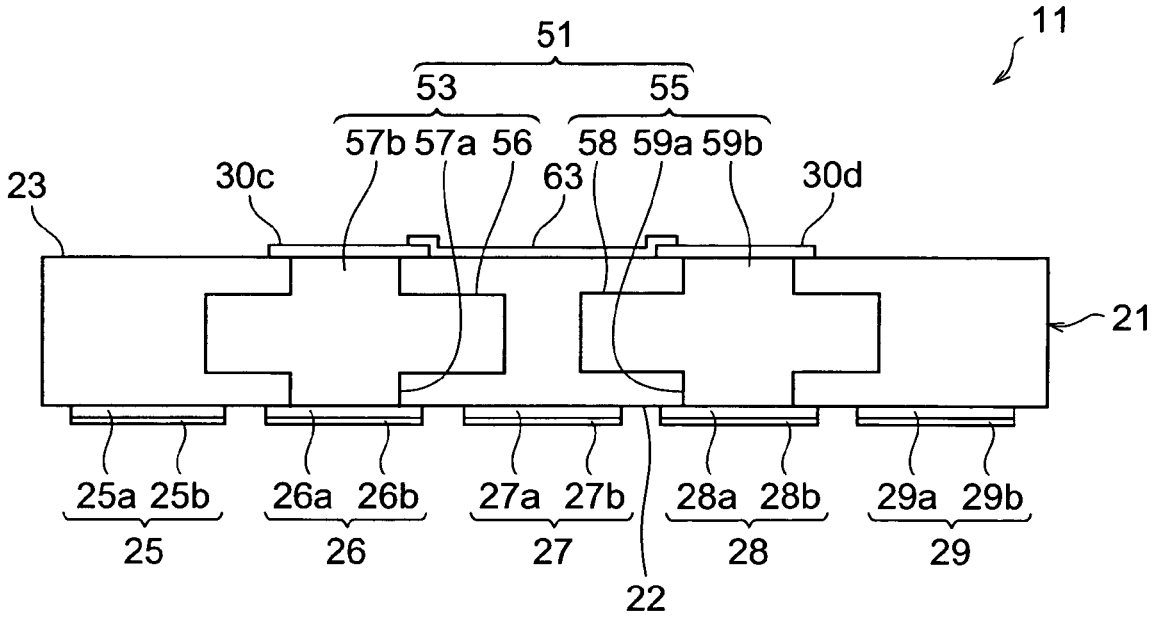
FIG. 5 is a view for explaining a sectional configuration along line V-V in FIG. 2.

A configuration of multilayer chip varistor 11 according to the first embodiment will be described with reference to FIGS. 1 to 5. FIG. 1 is a schematic top plan view showing the multilayer chip varistor of the first embodiment. FIG. 2 is a schematic bottom view showing the multilayer chip varistor of the first embodiment. FIG. 3 is a view for explaining a sectional configuration along line III-III in FIG. 2. FIG. 4 is a view for explaining a sectional configuration along line IV-IV in FIG. 2. FIG. 5 is a view for explaining a sectional configuration along line V-V in FIG. 2.

The multilayer chip varistor 11, as shown in FIGS. 1 to 5, comprises a varistor element body 21 of an approximately rectangular plate shape, a plurality of (twenty five in the present embodiment) external electrodes 25-29, and a plurality of (twenty in the present embodiment) external electrodes 30*a*-30*d*. The plurality of external electrodes 25-29 are disposed each on a first principal surface (outer surface) 22 of the varistor element body 21. The plurality of external electrodes 30*a*-30*d* are disposed each on a second principal surface (outer surface) 23 of the varistor element body 21. The varistor element body 21 is set, for example, to the vertical length of about 3 mm, the horizontal length of about 3 mm, and the thickness of about 0.5 mm. The external electrodes 25, 26, 28, 29 function as input/output terminal electrodes of the multilayer chip varistor 11. The external electrodes 27 function as ground terminal electrodes of the multilayer chip varistor 11. The external electrodes 30*a*-30*d* function as pad electrodes electrically connected to after-described resistors 61, 63.

The varistor element body 21 is constructed as a multilayer body in which a plurality of varistor layers to exhibit nonlinear voltage-current characteristics (hereinafter referred to as "varistor characteristics"), and a plurality of first to third internal electrode layers 31, 41, 51 are laminated. When first to third internal electrode layers 31, 41, 51 one each are defined as one internal electrode group, a plurality of (five in the present embodiment) such internal electrode groups are arranged in the laminate direction of the varistor layers (hereinafter referred to simply as "laminate direction") in the varistor element body 21. In each internal electrode group, the first to third internal electrode layers 31, 41, 51 are arranged in the order of the first internal electrode layer 31, second internal electrode layer 41, and third internal electrode layer 51 so that at least one varistor layer is interposed between them. Namely, when viewed from the laminate direction, the second internal electrode layer 41 is located between the first internal electrode layer 31 and the third internal electrode layer 51. The internal electrode groups are arranged so that at least one varistor layer is interposed between them. In practical multilayer chip varistor 11, the plurality of varistor layers are integrally formed so that no boundary can be visually recognized between them.

The varistor layers contain ZnO (zinc oxide) as a principal component and also contain as accessory components single metals, such as rare-earth metals, Co, IIIb elements (B, Al, Ga, In), Si, Cr, Mo, alkali metal elements (K, Rb, Cs), and alkaline earth metals (Mg, Ca, Sr, Ba), or oxides of them. In the present embodiment the varistor layers contain Pr, Co, Cr, Ca, Si, K, Al, and so on as accessory components. Regions of each varistor layer overlapping with the first internal electrode layer 31 and with the second internal electrode layer 41 and regions of each varistor layer overlapping with the second internal electrode layer 41 and with the third internal electrode layer 51 contain ZnO as a principal component and also contain Pr.

In the present embodiment Pr is used as the rare-earth metal. Pr is a material for making the varistor layers exhibit the varistor characteristics. The reason why Pr is used is that it is excellent in nonlinear voltage-current characteristics and has little characteristic variation in mass production. There are no particular restrictions on the content of ZnO in the varistor layers, but the content of ZnO is normally 99.8-69.0% by mass, based on 100% by mass of all the materials forming the varistor layers. The thickness of the varistor layers is, for example, approximately 5-60 μm.

Each first internal electrode layer 31, as shown in FIG. 3, includes a first internal electrode 33 and a second internal electrode 35. The first and second internal electrodes 33, 35 are located at respective locations with a predetermined space from side faces parallel to the laminate direction in the varistor element body 21. The first internal electrode 33 and second internal electrode 35 have such a predetermined space as to be electrically isolated from each other.

Each first internal electrode 33 includes a first electrode portion 36 and second electrode portions 37*a*, 37*b*. The first electrode portion 36, when viewed from the laminate direction, overlaps with a first electrode portion 46*a* of third internal electrode 43 described later. The first electrode portion 36 is of an approximately rectangular shape. The second electrode portion 37*a* is led from the first electrode portion 36 so as to be exposed in the first principal surface 22, and functions as a lead conductor. The second electrode portion 37*b* is led from the first electrode portion 36 so as to be exposed in the second principal surface 23, and functions as a lead conductor. Each first electrode portion 36 is electrically connected via the second electrode portion 37*a* to an external electrode 25 and electrically connected via the second electrode portion 37*b* to an external electrode 30*a*. The second electrode portions 37*a*, 37*b* are integrally formed with the first electrode portion 36.

Each second internal electrode 35 includes a first electrode portion 38 and second electrode portions 39*a*, 39*b*. The first electrode portion 38, when viewed from the laminate direction, overlaps with a first electrode portion 46*b* of third internal electrode 43 described later. The first electrode portion 38 is of an approximately rectangular shape. The second electrode portion 39*a* is led from the first electrode portion 38 so as to be exposed in the first principal surface 22, and functions as a lead conductor. The second electrode portion 39*b* is led from the first electrode portion 38 so as to be exposed in the second principal surface 23, and functions as a lead conductor. Each first electrode portion 38 is electrically connected via the second electrode portion 39*a* to an external electrode 25 and electrically connected via the second electrode portion 39*b* to an external electrode 30*a*. The second electrode portions 39*a*, 39*b* are integrally formed with the first electrode portion 38.

Each second internal electrode layer 41, as also shown in FIG. 4, includes a third internal electrode 43. Each third internal electrode 43 includes first electrode portions 46*a*, 46*b*, and a second electrode portion 47. The first electrode portion 46*a* is located at a position with a predetermined space from the side face parallel to the laminate direction in the varistor element body 21. The first electrode portion 46*a* is arranged to overlap with a first electrode portion 36 when viewed from the laminate direction. The first electrode portion 46*b* is located at a position with a predetermined space from the side faces parallel to the laminate direction in the varistor element body 21. The first electrode portion 46*b* is arranged to overlap with first electrode portion 38 when viewed from the laminate direction. The first electrode portions 46*a*, 46*b* are of an approximately rectangular shape. The second electrode portion 47 is led from the first electrode portion 46*a* and the first electrode portion 46*b* so as to be exposed in the first principal surface 22, and functions as a lead conductor. Each first electrode portion 46*a*, 46*b* is electrically connected via the second electrode portion 47 to an external electrode 27. The second electrode portion 47 is integrally formed with the first electrode portions 46*a*, 46*b*.

Each third internal electrode layer 51, as also shown in FIG. 5, includes a fourth internal electrode 53 and a fifth internal electrode 55. The fourth and fifth internal electrodes 53, 55 are located at their respective positions with a predetermined space from the side faces parallel to the laminate direction in the varistor element body 21. The fourth and fifth internal electrodes 53, 55 overlap with the third internal electrode 43 when viewed from the laminate direction. The fourth internal electrode 53 and the fifth internal electrode 55 have such a predetermined space as to be electrically isolated from each other.

Each fourth internal electrode 53 includes a first electrode portion 56 and second electrode portions 57*a*, 57*b*. The first electrode portion 56, when viewed from the laminate direction, overlaps with the first electrode portion 46*a* of the third internal electrode 43. The first electrode portion 56 is of an approximately rectangular shape. The second electrode portion 57*a* is led from the first electrode portion 56 so as to be exposed in the first principal surface 22, and functions as a lead conductor. The second electrode portion 57*b* is led from the first electrode portion 56 so as to be exposed in the second principal surface 23, and functions as a lead conductor. Each first electrode portion 56 is electrically connected via the second electrode portion 57*a* to an external electrode 25 and electrically connected via the second electrode portion 57*b* to an external electrode 30*a*. The second electrode portions 57*a*, 57*b* are integrally formed with the first electrode portion 56.

Each fifth internal electrode 55 includes a first electrode portion 58 and second electrode portions 59*a*, 59*b*. The first electrode portion 58, when viewed from the laminate direction, overlaps with the first electrode portion 46*b* of the third internal electrode 43. The first electrode portion 58 is of an approximately rectangular shape. The second electrode portion 59*a* is led from the first electrode portion 58 so as to be exposed in the first principal surface 22, and functions as a lead conductor. The second electrode portion 59*b* is led from the first electrode portion 58 so as to be exposed in the second principal surface 23, and functions as a lead conductor. Each first electrode portion 58 is electrically connected via the second electrode portion 59*a* to an external electrode 25 and electrically connected via the second electrode portion 59*b* to an external electrode 30*a*. The second electrode portions 59*a*, 59*b* are integrally formed with the first electrode portion 58.

The first to fifth internal electrodes 33, 35, 43, 53, 55 contain an electroconductive material. There are no particular restrictions on the electroconductive material contained in the first to fifth internal electrodes 33, 35, 43, 53, 55, but it is preferably Pd or Ag—Pd alloy. The thickness of the first to fifth internal electrodes 33, 35, 43, 53, 55 is, for example, approximately 0.5-5 μm.

The external electrodes 25-29 are two-dimensionally arrayed in a matrix of M rows and N columns (where each of parameters M and N is an integer of not less than 2) on the first principal surface 22. In the present embodiment the external electrodes 25-29 are two-dimensionally arrayed in a matrix of 5 rows and 5 columns. The external electrodes 25-29 are of a rectangular shape (square shape in the present embodiment). The external electrodes 25-29 are set, for example, to the length of about 300 μm on each side and the thickness of about 2 μm.

Each of the external electrodes 25-29 has a first electrode layer 25*a*-29*a* and a second electrode layer 25*b*-29*b*. The first electrode layers 25*a*-29*a* are disposed on the outer surface of the varistor element body 21 and contain Pd. The first electrode layers 25*a*-29*a* are formed by firing an electroconductive paste as described later. The electroconductive paste is a paste in which an organic binder and an organic solvent are mixed in metal powder consisting primarily of Pd particles. The metal powder may be one consisting primarily of Ag—Pd alloy particles.

The second electrode layers 25*b*-29*b* are disposed on the first electrode layers 25*a*-29*a*. The second electrode layers 25*b*-29*b* are formed by printing or by plating. The second electrode layers 25*b*-29*b* are made of Au or Pt. When the printing method is applied, the electroconductive paste prepared is one in which an organic binder and an organic solvent are mixed in metal powder consisting primarily of Au particles or Pt particles, the electroconductive paste is printed on the first electrode layers 25*a*-29*a*, and it is baked or fired to form the second electrode layers 25*b*-29*b*. When the plating method is applied, Au or Pt is evaporated by a vacuum plating method (vacuum vapor deposition, sputtering, ion plating, or the like) to form the second electrode layers 25*b*-29*b*. The second electrode layers 25*b*-29*b* of Pt are suitable mainly for mounting the multilayer chip varistor 11 on an external substrate or the like by solder reflow, and can achieve an improvement in solder leaching resistance and solderability. The second electrode layers 25*b*-29*b* of Au are suitable mainly for mounting the multilayer chip varistor 11 on an external substrate or the like by wire bonding.

The external electrodes 30*a* and external electrodes 30*b* are arranged with a predetermined space in a direction normal to the laminate direction of the varistor layers and parallel to the second principal surface 23, on the second principal surface 23. The external electrodes 30*c* and external electrodes 30*d* are arranged with a predetermined space in the direction normal to the laminate direction of the varistor layers and parallel to the second principal surface 23, on the second principal surface 23. The predetermined space between the external electrodes 30*a* and the external electrodes 30*b* is set to equal the predetermined space between the external electrodes 30*c* and the external electrodes 30*d*. The external electrodes 30*a*-30*d* are of a rectangular shape (oblong in the present embodiment). The external electrodes 30*a*, 30*b* are set, for example, to the length of the longer sides of about 1000 μm, the length of the shorter sides of about 150 μm, and the thickness of about 2 μm. The external electrodes 30*c*, 30*d* are set, for example, to the length of the longer sides of about 500 μm, the length of the shorter sides of about 150 μm, and the thickness of about 2 μm.

The external electrodes 30*a*-30*d* are formed by firing an electroconductive paste, as the first electrode layers 25*a*-29*a* are. This electroconductive paste is a paste in which an organic binder and an organic solvent are mixed in metal powder consisting primarily of Pt particles. The metal powder may be one consisting primarily of Ag particles or Pd particles or Ag—Pd alloy particles.

Resistors 61 are arranged so as to lie between the external electrodes 30*a* and the external electrodes 30*b*, on the second principal surface 23. Resistors 63 are arranged so as to lie between the external electrodes 30*c* and the external electrodes 30*d*, on the second principal surface 23. The resistors 61, 63 are formed by applying a Ru-based, Sn-based, or La-based resistive paste. The Ru-based resistive paste to be used can be a paste in which glass such as $Al_2O_3$—$B_2O_3$—$SiO_2$ is mixed in $RuO_2$. The Sn-based resistive paste to be used can be one in which glass such as $Al_2O_3$—$B_2O_3$—$SiO_2$ is mixed in $SnO_2$. The La-based resistive paste to be used can be one in which glass such as $Al_2O_3$—$B_2O_3$—$SiO_2$ is mixed in $LaB_6$.

One end of each resistor 61 is electrically connected via the external electrode 30*a* and second electrode portion 37*b* to the first electrode portion 36 (first internal electrode 33). The other end of each resistor 61 is electrically connected via the external electrode 30*b* and second electrode portion 39*b* to the first electrode portion 38 (second internal electrode 35). One end of each resistor 63 is electrically connected via the external electrode 30*c* and second electrode portion 57*b* to the first electrode portion 56 (fourth internal electrode 53). The other end of each resistor 63 is electrically connected via the external electrode 30*d* and second electrode portion 59*b* to the first electrode portion 58 (fifth internal electrode 55).

The first electrode portion 36 of the first internal electrode 33 and the first electrode portion 46*a* of the third internal electrode 43 overlap with each other between adjacent first internal electrode 33 and third internal electrode 43, as described above. The first electrode portion 38 of the second internal electrode 35 and the first electrode portion 46*b* of the third internal electrode 43 overlap with each other between adjacent second internal electrode 35 and third internal electrode 43, as described above. Therefore, the region of the varistor layer overlapping with the first electrode portion 36 and with the first electrode portion 46*a* functions as a region to exhibit the varistor characteristics. In addition, the region of the varistor layer overlapping with the first electrode portion 38 and with the first electrode portion 46*b* functions as a region to exhibit the varistor characteristics.

The first electrode portion 56 of the fourth internal electrode 53 and the first electrode portion 46*a* of the third internal electrode 43 overlap with each other between adjacent fourth internal electrode 53 and third internal electrode 43, as described above. The first electrode portion 58 of the fifth internal electrode 55 and the first electrode portion 46*b* of the third internal electrode 43 overlap with each other between adjacent fifth internal electrode 55 and third internal electrode 43, as described above. Therefore, the region of the varistor layer overlapping with the first electrode portion 56 and with the first electrode portion 46*a* functions as a region to exhibit the varistor characteristics. In addition, the region of the varistor layer overlapping with the first electrode portion 58 and with the first electrode portion 46*b* functions as a region to exhibit the varistor characteristics.

In the multilayer chip varistor 11 of the above-described configuration, one varistor portion is composed of the first electrode portion 36, the first electrode portion 46*a*, and the region of the varistor layer overlapping with the first electrode portion 36 and with the first electrode portion 46*a*. Similarly, one varistor portion is composed of the first electrode portion 38, the first electrode portion 46*b*, and the region of the varistor layer overlapping with the first electrode portion 38 and with the first electrode portion 46*b*. Likewise, one varistor portion is composed of the first electrode portion 56, the first electrode portion 46*a*, and the region of the varistor layer overlapping with the first electrode portion 56 and with the first electrode portion 46*a*. Likewise, one varistor portion is composed of the first electrode portion 58, the first electrode portion 46*b*, and the region of the varistor layer overlapping with the first electrode portion 58 and with the first electrode portion 46*b*.

The varistor element body 21 includes a plurality of varistor portions each composed of the first electrode portions 36, 46*a* and the region of the varistor layer overlapping with the first electrode portions 36, 46*a*, and a plurality of varistor portions each composed of the first electrode portions 56, 46*a* and the region of the varistor layer overlapping with the first electrode portions 56, 46*a*, which are alternately arranged along the laminate direction of the varistor layers. Similarly, the varistor element body 21 also includes a plurality of varistor portions each composed of the first electrode portions 38, 46*b* and the region of the varistor layer overlapping with the first electrode portions 38, 46*b*, and a plurality of varistor portions each composed of the first electrode portions 58, 46*b* and the region of the varistor layer overlapping with the first electrode portions 58, 46*b*, which are alternately arranged along the laminate direction of the varistor layers.

The varistor element body 21 further includes a varistor portion composed of the first electrode portions 36, 46*a* and the region of the varistor layer overlapping with the first electrode portions 36, 46*a*, and a varistor portion composed of the first electrode portions 38, 46*b* and the region of the varistor layer overlapping with the first electrode portions 38, 46*b*, which are arranged along the direction parallel to the varistor layer. Similarly, the varistor element body 21 also includes a varistor portion composed of the first electrode portions 56, 46*a* and the region of the varistor layer overlapping with the first electrode portions 56, 46*a*, and a varistor portion composed of the first electrode portions 58, 46*b* and the region of the varistor layer overlapping with the first electrode portions 58, 46*b*, which are arranged along the direction parallel to the varistor layer.

The paired principal surfaces 22, 23 of the varistor element body 21 face each other. The paired principal surfaces 22, 23 extend in parallel with the directions in which the aforementioned varistor portions are arranged. Namely, the paired principal surfaces 22, 23 extend in parallel with the laminate direction of the varistor layers, while the paired principal surfaces 22, 23 extend in parallel with the direction parallel to the varistor layers. The varistor element body 21 is of a plate shape having a pair of principal surfaces 22, 23 as described above. The distance between the paired principal surfaces 22, 23 is smaller than the lengths in the directions in which the varistor portions are arranged in the varistor element body 21, i.e., in the laminate direction of the varistor layers and in the direction parallel to the varistor layers. The distance between the paired principal surfaces 22, 23 is equivalent to the thickness of the varistor element body 21.

Figure 6:
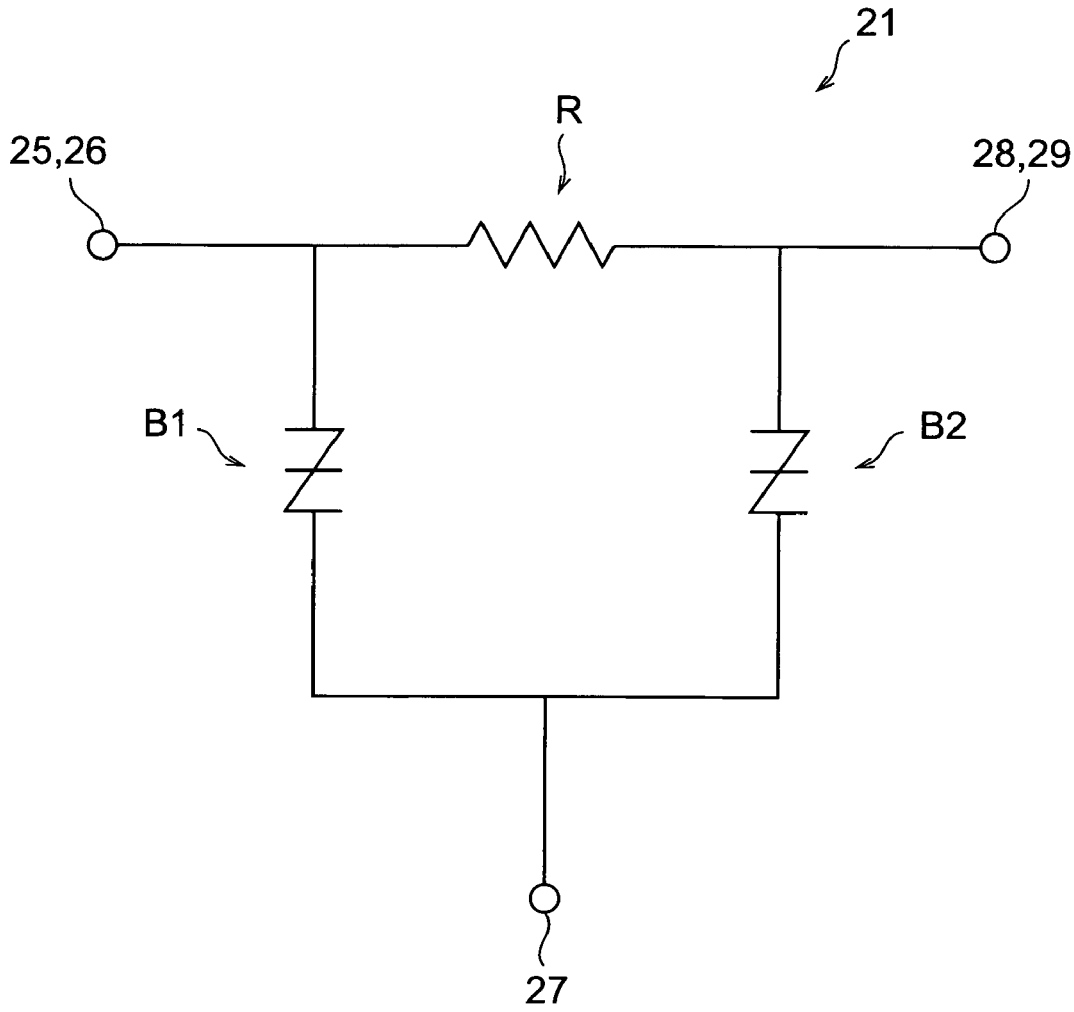
FIG. 6 is a drawing for explaining an equivalent circuit of the multilayer chip varistor according to the first embodiment.

In the multilayer chip varistor 11 of the above-described configuration, as shown in FIG. 6, resistor R, varistor B1, and varistor B2 are connected in π-shape. The resistor R corresponds to resistor 61 or resistor 63. The varistor B1 corresponds to a varistor portion composed of the first electrode portions 36, 46*a* and the region of the varistor layer overlapping with the first electrode portions 36, 46*a*, or to a varistor portion composed of the first electrode portions 56, 46*a* and the region of the varistor layer overlapping with the first electrode portions 56, 46*a*. The varistor B2 corresponds to a varistor portion composed of the first electrode portions 38, 46*b* and the region of the varistor layer overlapping with the first electrode portions 38, 46*b*, or to a varistor portion composed of the first electrode portions 58, 46*b* and the region of the varistor layer overlapping with the first electrode portions 58, 46*b*.

Figure 7:
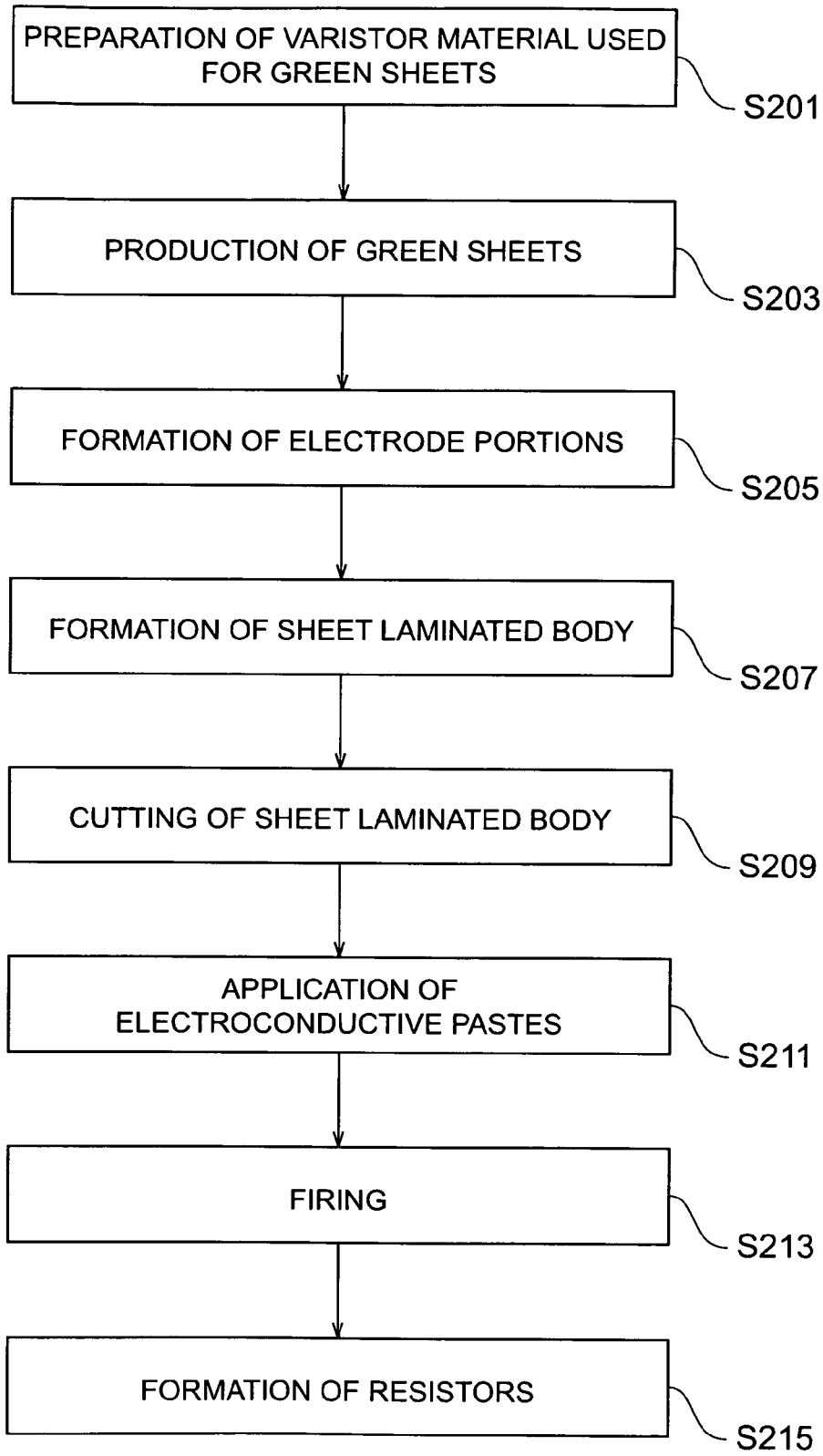
FIG. 7 is a flowchart for explaining a production process of the multilayer chip varistor according to the first embodiment.
Figure 8:
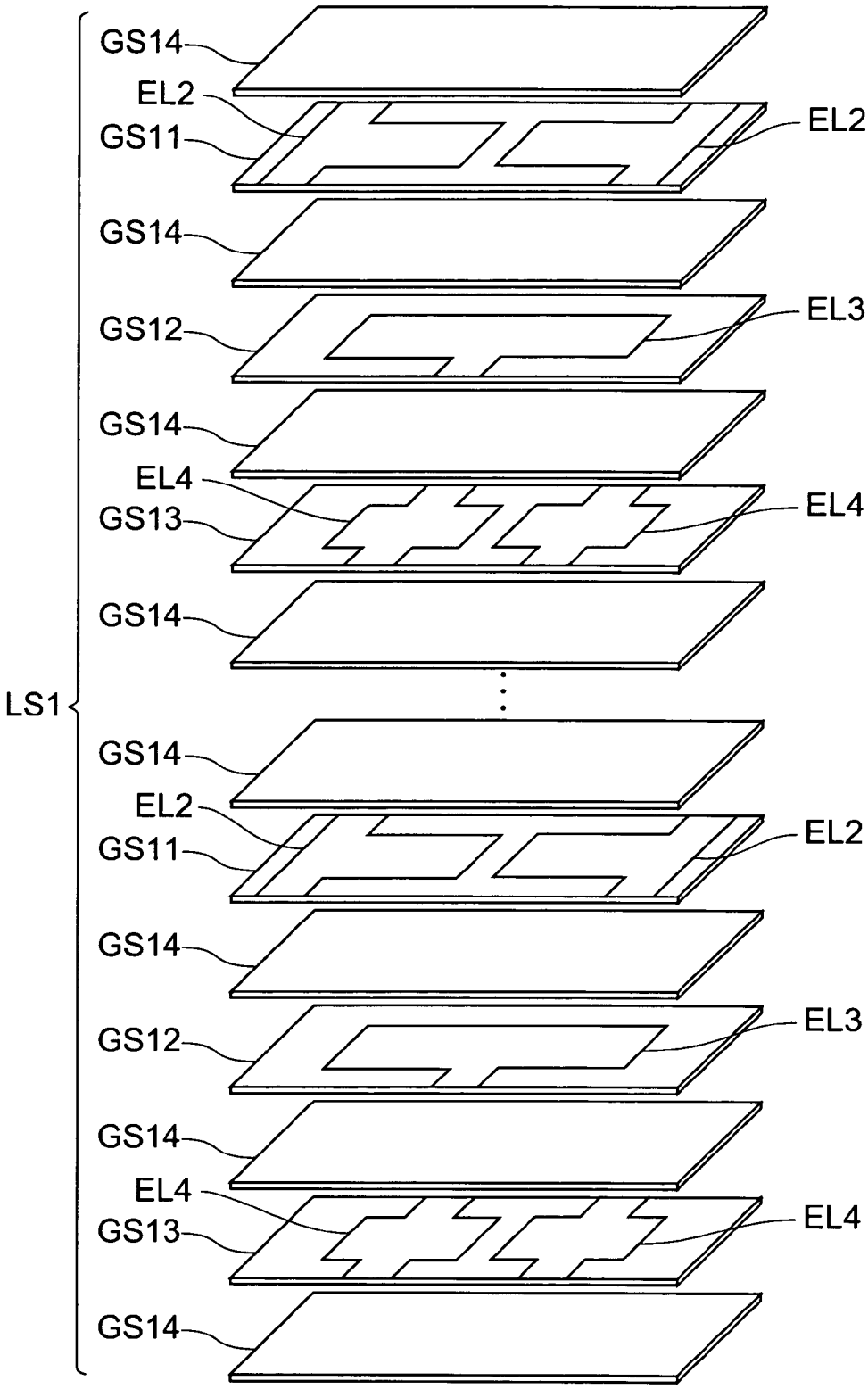
FIG. 8 is an illustration for explaining the production process of the multilayer chip varistor according to the first embodiment.

Subsequently, a production process of the multilayer chip varistor 11 having the above-described configuration will be described with reference to FIGS. 7 and 8. FIG. 7 is a flowchart for explaining the production process of the multilayer chip varistor according to the first embodiment. FIG. 8 is an illustration for explaining the production process of the multilayer chip varistor according to the first embodiment.

First, a varistor material is prepared by weighing each of ZnO as a principal component forming the varistor layers, and the additives of small amount, such as metals or oxides of Pr, Co, Cr, Ca, Si, K, and Al at a predetermined ratio and thereafter mixing them (step S201). Thereafter, an organic binder, an organic solvent, an organic plasticizer, etc. are added into this varistor material, and they are mixed and pulverized for about 20 hours by means of a ball mill or the like to obtain a slurry.

The slurry is applied onto film, for example, of polyethylene terephthalate by a known method, such as the doctor blade method, and then dried to form membranes in the thickness of about 30 μm. The membranes obtained are peeled off from the polyethylene terephthalate film to obtain green sheets (step S203).

Next, a plurality of electrode portions corresponding to the first and second internal electrodes 33, 35 are formed (in a number corresponding to the number of divided chips described later) on green sheets (step S205). Similarly, a plurality of electrode portions corresponding to the third internal electrodes 43 are formed (in the number corresponding to the number of divided chips described later) on other green sheets (step S205). Furthermore, a plurality of electrode portions corresponding to the fourth and fifth internal electrodes 53, 55 are formed (in the number corresponding to the number of divided chips described later) on still other green sheets (step S205). The electrode portions corresponding to the first to fifth internal electrodes 33, 35, 43, 53, 55 are formed by printing an electroconductive paste as a mixture of metal powder consisting primarily of Pd particles, an organic binder, and an organic solvent by a printing method, such as screen printing, and drying it.

Next, the green sheets with the electrode portions, and green sheets without electrode portions are laminated in a predetermined order to form a sheet laminated body (step S207). The sheet laminated body obtained is cut in chip units to obtain a plurality of divided green bodies LS1 (cf. FIG. 8) (step S209). A green body LS1 obtained includes a successive laminate of green sheets GS11 with electrode portions EL2 corresponding to the first and second internal electrodes 33, 35, green sheets GS12 with electrode portion EL3 corresponding to the third internal electrode 43, green sheets GS13 with electrode portions EL4 corresponding to the fourth and fifth internal electrodes 53, 55, and green sheets GS14 without electrode portions EL2-EL4. A plurality of green sheets GS14 without electrode portions EL2-EL4 may be laminated at each location as occasion may demand.

Next, the electroconductive paste for the first electrode layers 25*a*-29*a* of the external electrodes 25-29 and for the external electrodes 30*a*-30*d* and the electroconductive paste for the second electrode layers 25*b*-29*b* of the external electrodes 25-29 are applied onto the outer surface of the green body LS1 (step S211). In this step, the electrode portions corresponding to the first electrode layers 25*a*-29*a* are formed by printing the electroconductive paste by screen printing so as to contact the corresponding electrode portions EL2-EL4, on the first principal surface of the green body LS1, and thereafter drying it. Then the electrode portions corresponding to the second electrode layers 25*b*-29*b* are formed by printing the electroconductive paste onto the electrode portions corresponding to the first electrode layers 25*a*-29*a* by screen printing and thereafter drying it. Furthermore, the electrode portions corresponding to the external electrodes 30*a*-30*d* are formed by printing the electroconductive paste by screen printing so as to contact the corresponding electrode portions EL2, EL4, on the second principal surface of the green body LS1, and drying it. The electroconductive paste for the first electrode layers 25*a*-29*a* and for the external electrodes 30*a*-30*d* can be one in which an organic binder and an organic solvent are mixed in metal powder consisting primarily of Ag—Pd alloy particles or Pd particles, as described above. The electroconductive paste for the second electrode layers 25*b*-29*b* can be one in which an organic binder and an organic solvent are mixed in metal powder consisting primarily of Pt particles, as described above. These electroconductive pastes contain no glass frit.

Next, the green body LS1 with the electroconductive pastes is subjected to a heat treatment at 180-400° C. and for about 0.5-24 hours to effect debinder, and thereafter is further fired at 1000-1400° C. for about 0.5-8 hours (step S213) to obtain the varistor element body 21, the first electrode layers 25*a*-29*a*, the second electrode layers 25*b*-29*b*, and the external electrodes 30*a*-30*d*. This firing turns the green sheets GS11-GS14 in the green body LS1 into varistor layers. The electrode portions EL2 become the first and second internal electrodes 33, 35. The electrode portions EL3 become the third internal electrodes 43. The electrode portions EL4 become the fourth and fifth internal electrodes 53, 55.

Next, the resistors 61, 63 are formed (step S215). This completes the multilayer chip varistor 11. The resistors 61, 63 are formed as follows. First, resistive regions corresponding to the resistors 61, 63 are formed so as to lie between each pair of external electrode 30*a* and external electrode 30*b* and between each pair of external electrode 30*c* and external electrode 30*d*, on the second principal surface 23 of the varistor element body 21. The resistive regions corresponding to the resistors 61, 63 are formed by printing the aforementioned resistive paste by screen printing and drying it. Then the resistive paste is baked at a predetermined temperature to obtain the resistors 61, 63.

After the firing, an alkali metal (e.g., Li, Na, or the like) may be diffused from the surface of the varistor element body 21. In addition, an insulating layer (protecting layer) may also be formed except for the regions where the external electrodes 25-29 are formed, on the outer surface of the multilayer chip varistor 11. The insulating layer can be formed by printing glaze glass (e.g., glass made of $SiO_2$, ZnO, B, $Al_2O_3$, etc., or the like) and baking it at a predetermined temperature.

In the first embodiment, as described above, the varistor element body 21 includes the plurality of varistor portions, and the plurality of external electrodes 25-29 are disposed on the first principal surface 22 of the varistor element body 21. The plurality of external electrodes 25-29 are electrically connected via the second electrode portions 37*a*, 39*a*, 47, 57*a*, 59*a* to the corresponding internal electrodes 33, 35, 43, 53, 55. Therefore, when the multilayer chip varistor is mounted on an external substrate or the like in a state in which the first principal surface 22 with the plurality of external electrodes 25-29 is opposed to the external substrate, the plurality of varistor portions are mounted on the external substrate. This can reduce the mounting area in mounting the plurality of varistor portions. Furthermore, it is also feasible to achieve easy mounting, while reducing the mounting cost for mounting of the plurality of varistor portions.

Incidentally, in the multilayer chip varistor 11 of the first embodiment the external electrodes 25, 26, 28, 29 functioning as input/output terminal electrodes and the external electrodes 27 functioning as ground terminal electrodes are arranged on the first principal surface 22 of the varistor element body 21. Namely, the multilayer chip varistor 11 is a multilayer chip varistor arranged as a BGA (Ball Grid Array) package. The multilayer chip varistor 11 is mounted on an external substrate by electrically and mechanically (physically) connecting the external electrodes 25-29 to respective lands of the external substrate corresponding to the external electrodes 25-29 by means of solder balls. In a state in which the multilayer chip varistor 11 is mounted on the external substrate, each internal electrode 33, 35, 43, 53, 55 extends in the direction perpendicular to the external substrate.

In the first embodiment, the second electrode portions 37*b*, 39*b*, 57*b*, 59*b* of the internal electrodes 33, 35, 53, 55 are led so as to be exposed in the second principal surface 23 of the varistor element body 21, and the multilayer chip varistor 11 has the plurality of external electrodes 30*a*-30*d* disposed on the second principal surface 23 of the varistor element body 21 and electrically connected via the second electrode portions 37*b*, 39*b*, 57*b*, 59*b* to the corresponding internal electrodes 33, 35, 53, 55, respectively. This permits another electric circuit element, device, or the like to be readily mounted on the second principal surface 23 of the varistor element body 21.

In the first embodiment, the multilayer chip varistor 11 has the plurality of resistors 61 disposed on the second principal surface 23 with the plurality of external electrodes 30*a*-30*d* thereon and each electrically connected to a pair of external electrodes 30*a*, 30*b*. Furthermore, the multilayer chip varistor 11 also has the plurality of resistors 63 disposed on the second principal surface 23 and each electrically connected to a pair of external electrodes 30*c*, 30*d*. This permits the resistors 61, 63 to be readily mounted by use of the second principal surface 23 facing the first principal surface 22 with the plurality of external electrodes 25-29 thereon. It is feasible to construct the multilayer chip varistor 11 as a composite component.

In the first embodiment, the varistor element body 21 is of the plate shape having the pair of principal surfaces 22, 23, and the distance between the pair of principal surfaces 22, 23 is smaller than the lengths of the varistor element body 21 in the arrangement directions of the varistor portions. This permits the multilayer chip varistor 11 to be constructed in a low profile.

In the first embodiment, the green body LS1 contains Pr, the electroconductive paste for the first electrode layers 25*a*-29*a* of the external electrodes 25-29 and for the external electrodes 30*a*-30*d* contains Pd, and the green body LS1 with the electroconductive paste is fired to obtain the varistor element body 21, first electrode layers 25*a*-29*a*, and external electrodes 30*a*-30*d*; therefore, the varistor element body 21, first electrode layers 25*a*-29*a*, and external electrodes 30*a*-30*d* are simultaneously fired. This can achieve an improvement in the bonding strength of the varistor element body 21 to the external electrodes 25-29 (first electrode layers 25*a*-29*a*) and to the external electrodes 30*a*-30*d*.

The effect of the improvement in the bonding strength between the varistor element body 21 and the external electrodes 25-29, 30*a*-30*d* is considered to arise from the following phenomenon during the firing. During the firing of the green body LS1 and the electroconductive paste, Pr in the green body LS1 migrates to near the surface of the green body LS1, i.e., to near the interface between the green body LS1 and the electroconductive paste. Then Pr coming to near the interface between the green body LS1 and the electroconductive paste, and Pd in the electroconductive paste counter-diffuse. The counter diffusion of Pr and Pd can result in forming an oxide of Pr and Pd (e.g., $Pr_2Pd_2O_5$ or $Pr_4PdO_7$ or the like) in the neighborhood of interfaces (also including the interfaces) between the varistor element body 21 and the external electrodes 25-29, 30*a*-30*d*. The oxide of Pr and Pd provides the anchor effect to achieve the improvement in the bonding strength between the varistor element body 21 and the external electrodes 25-29, 30*a*-30*d* obtained by the firing.

The multilayer chip varistor in the form of the BGA package has a particularly small area of the external electrodes functioning as input/output terminal electrodes or as ground terminal electrodes. For this reason, the bonding strength is so small between the varistor element body and the external electrodes that the external electrodes can be peeled off from the varistor element body. However, since the multilayer chip varistor 11 of the first embodiment is improved in the bonding strength between the varistor element body 21 and the external electrodes 25-29 (first electrode layers 25*a*-29*a*) as described above, the external electrodes 25-29 are prevented from being peeled off from the varistor element body 21.

If the electroconductive paste for formation of the first electrode layers 25*a*-29*a* should contain glass frit, the glass component could separate out to the surfaces of the first electrode layers 25*a*-29*a* during the firing, so as to degrade plateability and solder wettability. However, since in the present first embodiment the electroconductive paste for formation of the first electrode layers 25*a*-29*a* contains no glass frit, there occurs no degradation of plateability and solder wettability.

Second Embodiment

Figure 9:
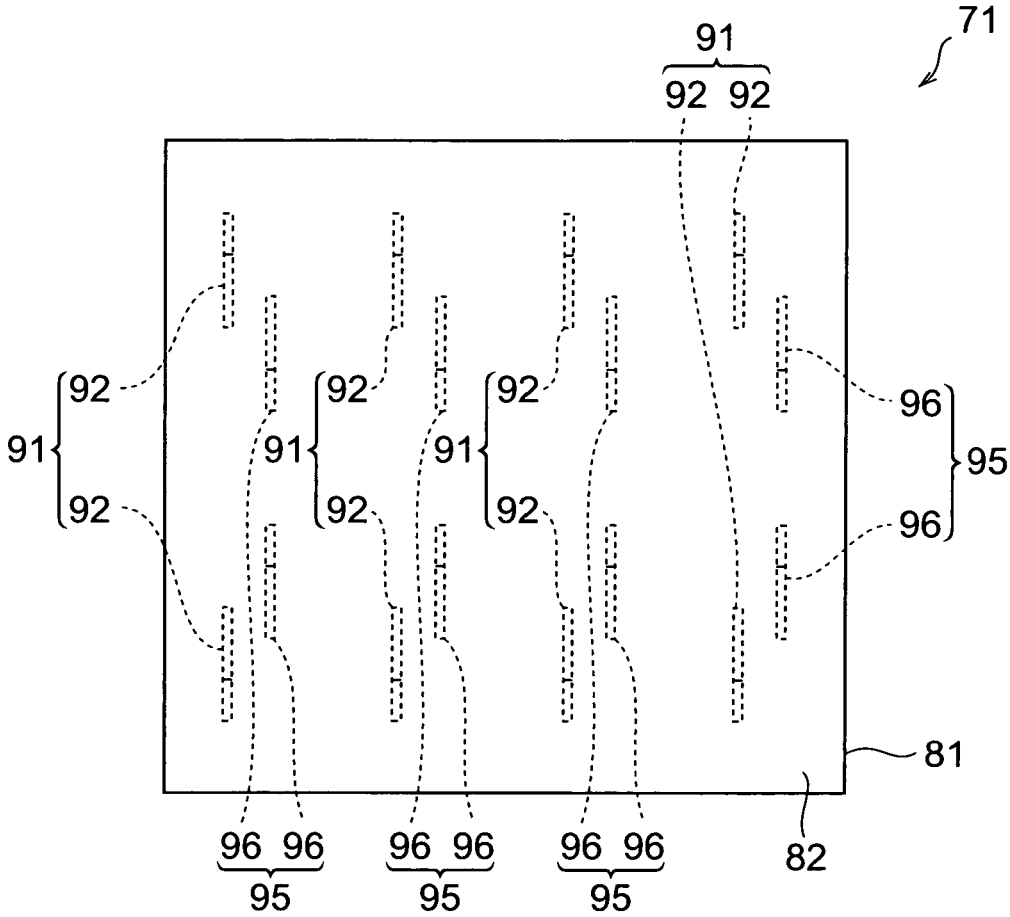
FIG. 9 is a schematic top view showing a multilayer chip varistor according to the second embodiment.
Figure 10:
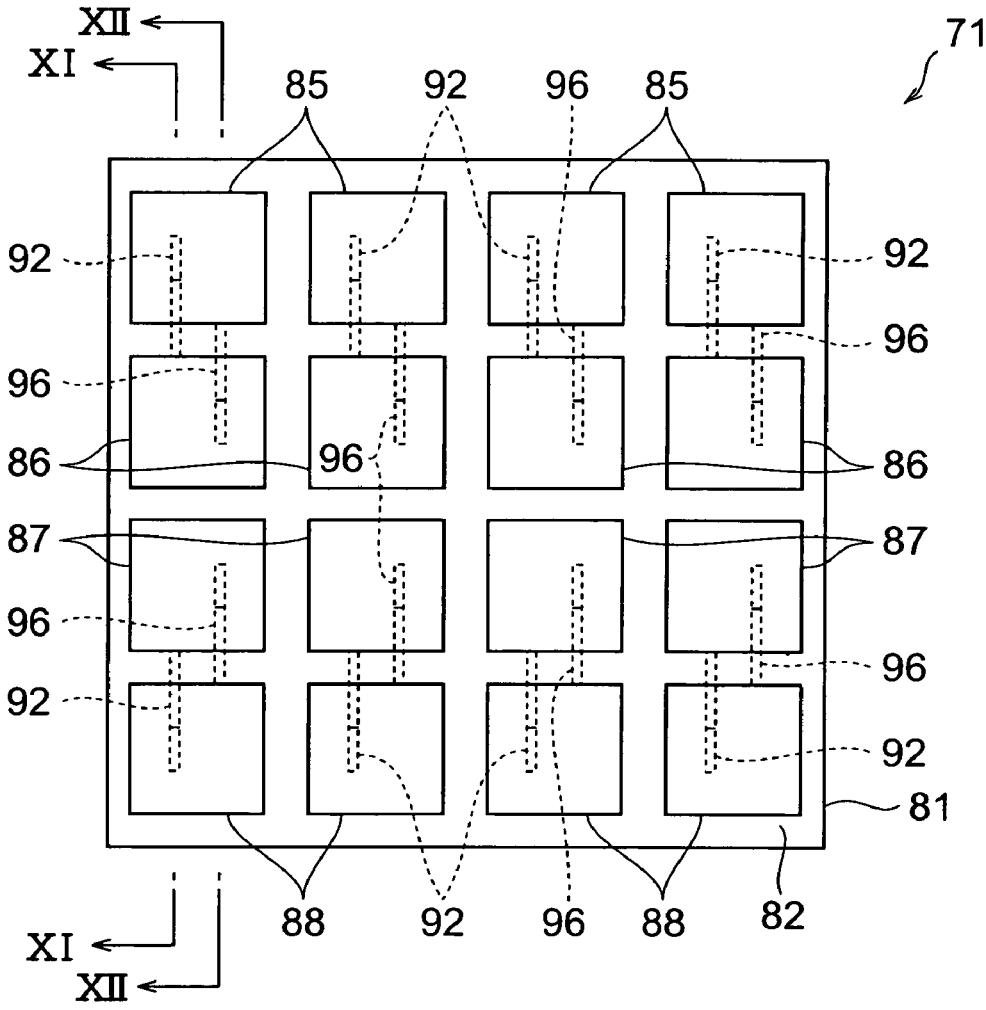
FIG. 10 is a schematic bottom view showing the multilayer chip varistor according to the second embodiment.
Figure 11:
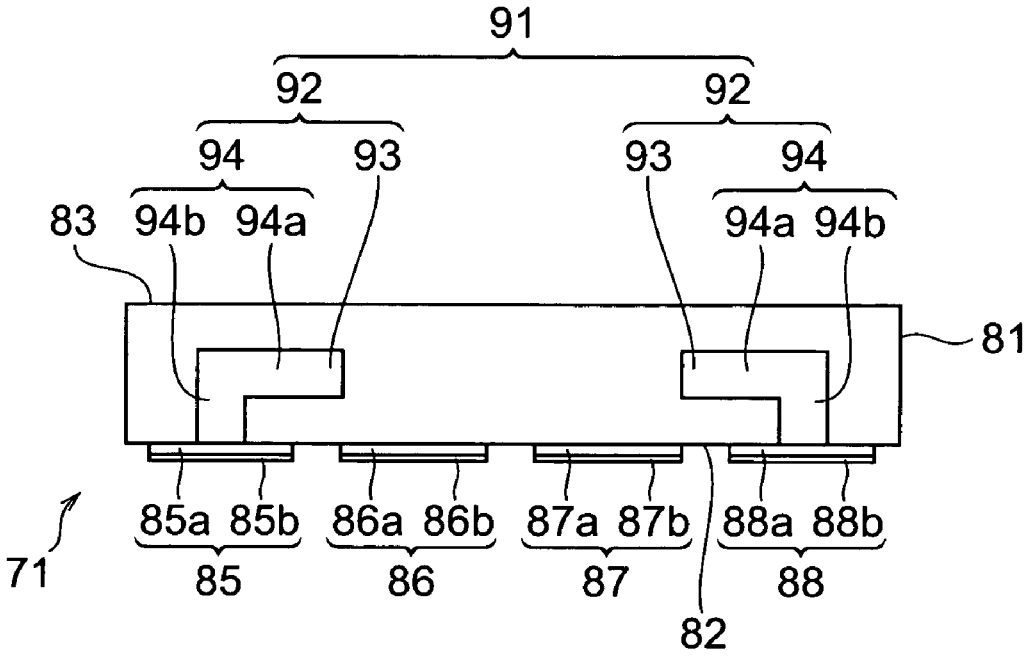
FIG. 11 is a view for explaining a sectional configuration along line XI-XI in FIG. 10.
Figure 12:
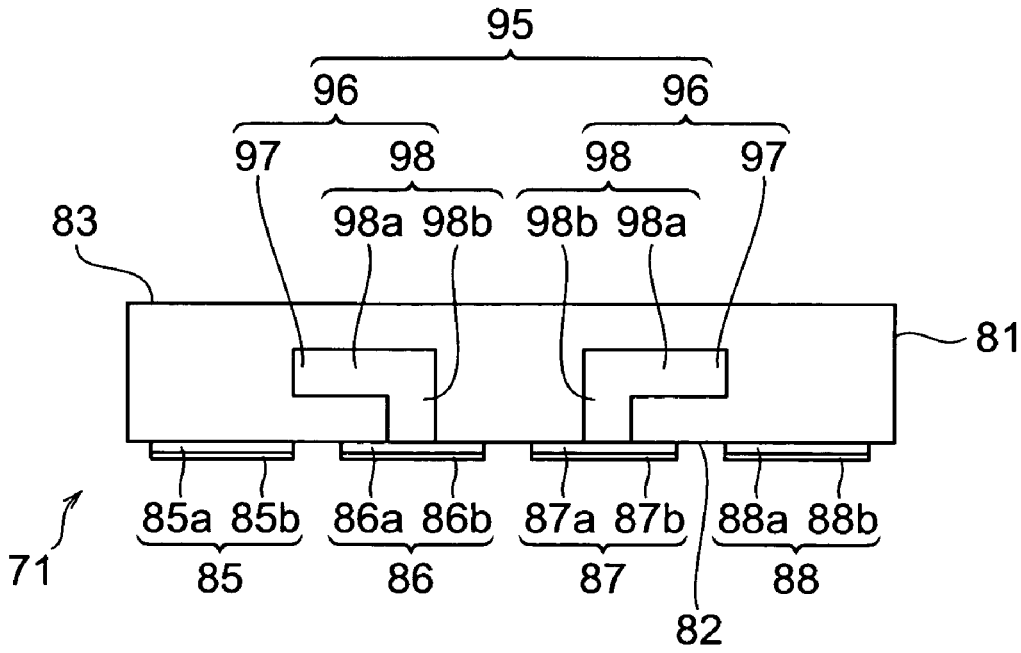
FIG. 12 is a view for explaining a sectional configuration along line XII-XII in FIG. 10.

A configuration of multilayer chip varistor 71 according to the second embodiment will be described with reference to FIGS. 9 to 12. FIG. 9 is a schematic top view showing the multilayer chip varistor according to the second embodiment. FIG. 10 is a schematic bottom view showing the multilayer chip varistor according to the second embodiment. FIG. 11 is a view for explaining a sectional configuration along line XI-XI in FIG. 10. FIG. 12 is a view for explaining a sectional configuration along line XII-XII in FIG. 10.

The multilayer chip varistor 71, as shown in FIGS. 9-12, has a varistor element body 81 of an approximately rectangular plate shape, and a plurality of (sixteen in the present embodiment) external electrodes 85-88. The plurality of external electrodes 85-88 are disposed each on a first principal surface (outer surface) 82 of the varistor element body 81. The varistor element body 81 has a second principal surface (outer surface) 83 facing the first principal surface 82. The varistor element body 81 is set, for example, to the vertical length of about 2 mm, the horizontal length of about 2 mm, and the thickness of about 0.5 mm. The external electrodes 85, 88 function as input terminal electrodes of the multilayer chip varistor 71. The external electrodes 86, 87 function as ground terminal electrodes of the multilayer chip varistor 71.

Just like the aforementioned varistor element body 21, the varistor element body 81 is constructed as a multilayer body in which a plurality of varistor layers to exhibit the varistor characteristics and a plurality of first and second internal electrode layers 91, 95 are laminated. When the first and second internal electrode layers 91, 95 one each are defined as one internal electrode group, a plurality of (four in the present embodiment) internal electrode groups are arranged along the laminate direction in the varistor element body 81. In the internal electrode groups, the first internal electrode layers 91 and the second internal electrode layers 95 are alternately arranged so that at least one varistor layer is interposed between the first and second internal electrode layers 91, 95. The internal electrode groups are arranged so that at least one varistor layer is interposed between them. In practical multilayer chip varistor 71, the plurality of varistor layers are integrally formed so that no boundary can be visually recognized between them.

The varistor layers contain ZnO (zinc oxide) as a principal component and also contain as accessory components single metals, such as rare-earth metals, Co, IIIb elements (B, Al, Ga, In), Si, Cr, Mo, alkali metal elements (K, Rb, Cs), and alkaline earth metals (Mg, Ca, Sr, Ba), or oxides of them. In the present embodiment the varistor layers contain Pr, Co, Cr, Ca, Si, K, Al, and so on as accessory components. Regions overlapping with the first internal electrode layers 91 and with the second internal electrode layers 95 contain ZnO as a principal component and also contain Pr. In the present embodiment, similar to the first embodiment, the rare-earth metal is Pr.

Each first internal electrode layer 91, as shown in FIG. 11, includes a plurality of (two in the present embodiment) first internal electrodes 92. Each first internal electrode 92 is located at a position with a predetermined space from a side face parallel to the laminate direction in the varistor element body 81. The first internal electrodes 92 have such a predetermined space as to be electrically isolated from each other. Each first internal electrode 92 includes a first electrode portion 93 and a second electrode portion 94.

The first electrode portion 93, when viewed from the laminate direction, overlaps with a first electrode portion 97 of second internal electrode 96 described later. The first electrode portion 93 is of an approximately rectangular shape. The second electrode portion 94 is led from the first electrode portion 93 so as to be exposed in the first principal surface 82, and functions as a lead conductor. The second electrode portion 94 includes a first region 94*a* extending from the first electrode portion 93 in a direction normal to the facing direction of the pair of principal surfaces 82, 83 and normal to the laminate direction, and a second region 94*b* extending from the first region 94*a* in the facing direction of the pair of principal surfaces 82, 83. Each first electrode portion 93 is electrically connected via the second electrode portion 94 to an external electrode 85 or 88. The second electrode portion 94 is integrally formed with the first electrode portion 93.

Each second internal electrode layer 95, as shown in FIG. 12, includes a plurality of (two in the present embodiment) second internal electrodes 96. Each second internal electrode 96 is located at a position with a predetermined space from the side face parallel to the laminate direction in the varistor element body 81. The second internal electrodes 96 have such a predetermined space as to be electrically isolated from each other. Each second internal electrode 96 includes a first electrode portion 97 and a second electrode portion 98.

The first electrode portion 97 overlaps with a first electrode portion 93 of first internal electrode 92, when viewed from the laminate direction. The first electrode portion 97 is of an approximately rectangular shape. The second electrode portion 98 is led from the first electrode portion 97 so as to be exposed in the first principal surface 82, and functions as a lead conductor. The second electrode portion 98 includes a first region 98*a* extending from the first electrode portion 97 in the direction normal to the facing direction of the pair of principal surfaces 82, 83 and normal to the laminate direction, and a second region 98*b* extending from the first region 98*a* in the facing direction of the pair of principal surfaces 82, 83. Each first electrode portion 97 is electrically connected via the second electrode portion 98 to an external electrode 86 or 87. The second electrode portion 98 is integrally formed with the first electrode portion 97.

In the present embodiment, the width of the first electrode portion 93 (the length in the facing direction of the pair of principal surfaces 82, 83), the width of the first region 94*a* of the second electrode portion 94 (the length in the facing direction of the pair of principal surfaces 82, 83), and the width of the second region 94*b* of the second electrode portion 94 (the length in the direction normal to the facing direction of the pair of principal surfaces 82, 83 and normal to the laminate direction) are set to be approximately equal to each other. Furthermore, the width of the first electrode portion 97 (the length in the facing direction of the pair of principal surfaces 82, 83), the width of the first region 98*a* of the second electrode portion 98 (the length in the facing direction of the pair of principal surfaces 82, 83), and the width of the second region 98*b* of the second electrode portion 98 (the length in the direction normal to the facing direction of the pair of principal surfaces 82, 83 and normal to the laminate direction) are set to be approximately equal to each other.

The first internal electrodes 92 and second internal electrodes 96 contain an electroconductive material as the aforementioned first to fifth internal electrodes 33, 35, 43, 53, 55 do. There are no particular restrictions on the electroconductive material in the first internal electrodes 92 and the second internal electrodes 96, but it is preferably Pd or Ag—Pd alloy. The thickness of the first internal electrodes 92 and the second internal electrodes 96 is, for example, about 0.5-5 μm.

The external electrodes 85-88 are two-dimensionally arrayed in a matrix of M rows and N columns (where each of parameters M and N is an integer of not less than 2) on the first principal surface 82. In the present embodiment the external electrodes 85-88 are two-dimensionally arrayed in a matrix of 4 rows and 4 columns. The external electrodes 85-88 are of a rectangular shape (square shape in the present embodiment).

The external electrodes 85-88 are set, for example, to the length of about 300 μm on each side and the thickness of about 2 μm.

Each of the external electrodes 85-88 has a first electrode layer 85*a*-88*a* and a second electrode layer 85*b*-88*b* as the aforementioned external electrodes 25-29 do. The first electrode layers 85*a*-88*a* are disposed on the outer surface of the varistor element body 81 and contain Pd. The first electrode layers 85*a*-88*a* are formed by firing an electroconductive paste as described later. The electroconductive paste is one in which an organic binder and an organic solvent are mixed in metal powder consisting primarily of Pd particles. The metal powder may be one consisting primarily of Ag—Pd alloy particles. The second electrode layers 85*b*-88*b* are disposed on the first electrode layers 85*a*-88*a* as the aforementioned second electrode layers 25*b*-29*b* are. The second electrode layers 85*b*-88*b* are formed by printing or by plating. The second electrode layers 85*b*-88*b* are made of Au or Pt.

The first electrode portion 93 of the first internal electrode 92 and the first electrode portion 97 of the second internal electrode 96 overlap with each other between adjacent first internal electrode 92 and second internal electrode 96, as described above. Therefore, a region of the varistor layer overlapping with the first electrode portion 93 and with the first electrode portion 97 functions as a region to exhibit the varistor characteristics.

In the multilayer chip varistor 71 having the above-described configuration, one varistor portion is composed of a first electrode portion 93, a first electrode portion 97, and a region of the varistor layer overlapping with the first electrode portion 93 and with the first electrode portion 97. In the varistor element body 81, a plurality of varistor portions each composed of the first electrode portions 93, 97 and the region of the varistor layer overlapping with the first electrode portions 93, 97 are alternately arranged along the laminate direction of the varistor layers. In the varistor element body 81, varistor portions each composed of the first electrode portions 93, 97 and the region of the varistor layer overlapping with the first electrode portions 93, 97 are arranged along the direction parallel to the varistor layers. The laminate direction of the varistor layers is a direction parallel to the first principal surface 82. The direction parallel to the varistor layers is also a direction parallel to the first principal surface 82.

The paired principal surfaces 82, 83 of the varistor element body 81 face each other. The paired principal surfaces 82, 83 are parallel to the directions in which the aforementioned varistor portions are arranged, i.e., the laminate direction of the varistor layers and the direction parallel to the varistor layers. The varistor element body 81 is of a plate shape having the pair of principal surfaces 82, 83 as described above. The distance between the paired principal surfaces 82, 83 is smaller than the lengths in the directions in which the varistor portions are arranged in the varistor element body 81, i.e., the laminate direction of the varistor layers and the direction parallel to the varistor layers. The distance between the paired principal surfaces 82, 83 is equivalent to the thickness of the varistor element body 81.

Subsequently, a production process of the multilayer chip varistor 71 having the above-described configuration will be described.

First, in the same manner as in the first embodiment, each of ZnO as a principal component to form the varistor layers, and the additives of small amount, such as metals or oxides of Pr, Co, Cr, Ca, Si, K, and Al is weighed at a predetermined ratio, and they are then mixed to prepare a varistor material. Thereafter, an organic binder, an organic solvent, an organic plasticizer, etc. are added into this varistor material and they are mixed and pulverized for about 20 hours by means of a ball mill or the like to obtain a slurry. This slurry is applied onto film, for example, of polyethylene terephthalate by a known method, such as the doctor blade method, and thereafter is dried to obtain membranes in the thickness of about 30 μm. The membranes obtained are peeled off from the polyethylene terephthalate film to obtain green sheets.

Next, a plurality of electrode portions corresponding to the first and second internal electrodes 92, 96 are formed (in a number corresponding to the number of divided chips described later) on green sheets. The electrode portions corresponding to the first and second internal electrodes 92, 96 are formed by printing an electroconductive paste as a mixture of metal powder consisting primarily of Pd particles, an organic binder, and an organic solvent by a printing method, such as screen printing, and drying it.

Next, the green sheets with the electrode portions, and green sheets without electrode portions are laminated in a predetermined order to form a sheet laminated body. The sheet laminated body obtained is cut in chip units to obtain a plurality of divided green bodies.

The electroconductive paste for the first electrode layers 85*a*-88*a* of the external electrodes 85-88 and the electroconductive paste for the second electrode layers 85*b*-88*b* of the external electrodes 85-88 are applied onto the outer surface of the green body. In this case, the electrode portions corresponding to the first electrode layers 85*a*-88*a* are formed by printing the electroconductive paste by screen printing so as to contact the corresponding electrode portions formed on the green sheets, on the first principal surface of the green body, and thereafter drying it. Then the electrode portions corresponding to the second electrode layers 85*b*-88*b* are formed by printing the electroconductive paste by screen printing on the electrode portions corresponding to the first electrode layers 85*a*-88*a*, and drying it.

The electroconductive paste for the first electrode layers 85*a*-88*a* can be one in which an organic binder and an organic solvent are mixed in metal powder consisting primarily of Ag—Pd alloy particles or Pd particles, as described above. The electroconductive paste for the second electrode layers 85*b*-88*b* can be one in which an organic binder and an organic solvent are mixed in metal powder consisting primarily of Pt particles, as described above. These electroconductive pastes contain no glass frit.

Then the green body with the electroconductive pastes is subjected to a heat treatment at 180-400° C. and for about 0.5-24 hours to effect debinder, and thereafter is further fired at 1000-1400° C. for about 0.5-8 hours to obtain the varistor element body 81, first electrode layers 85*a*-88*a*, and second electrode layers 85*b*-88*b*. This firing turns the green sheets in the green body into varistor layers. The electrode portions formed on the green sheets become the first and second internal electrodes 92, 96.

After the firing, an alkali metal (e.g. Li, Na, or the like) may be diffused from the surface of the varistor element body 81. An insulating layer (protecting layer) may also be formed except for the regions where the external electrodes 85-88 are formed, on the outer surface of the multilayer chip varistor 71. The insulating layer can be formed by printing glaze glass (e.g., glass made of $SiO_2$, ZnO, B, $Al_2O_3$, etc., or the like) and baking it at a predetermined temperature.

In the second embodiment, as described above, the varistor element body 81 includes the plurality of varistor portions, and the plurality of external electrodes 85-88 are disposed on the first principal surface 82 of the varistor element body 81. The plurality of external electrodes 85-88 are electrically connected via the second electrode portions 94, 98 to the corresponding internal electrodes 92, 96. Therefore, when the chip varistor is mounted on an external substrate or the like in a state in which the first principal surface 82 with the plurality of external electrodes 85-88 thereon is opposed to the external substrate, the plurality of varistor portions are mounted on the external substrate. This can reduce the mounting area in mounting the plurality of varistor portions. It is also feasible to achieve easy mounting, while reducing the mounting cost for mounting the plurality of varistor portions.

Incidentally, the multilayer chip varistor 71 of the second embodiment is also a multilayer chip varistor arranged as a BGA package as the multilayer chip varistor 11 of the first embodiment is. The multilayer chip varistor 71 is mounted on an external substrate by electrically and mechanically (physically) connecting the external electrodes 85-88 to respective lands of the external substrate corresponding to the external electrodes 85-88 by means of solder balls. In a state in which the multilayer chip varistor 71 is mounted on the external substrate, each internal electrode 92, 96 extends in the direction perpendicular to the external substrate.

In the second embodiment the varistor element body 81 is of the plate shape having the pair of principal surfaces 82, 83, and the distance between the pair of principal surfaces 82, 83 is smaller than the lengths in the directions in which the varistor portions are arranged in the varistor element body 81. This permits the multilayer chip varistor 71 to be constructed in a low profile.

In the second embodiment, similar to the first embodiment, the green body contains Pr, the electroconductive paste for the first electrode layers 85*a*-88*a* of the external electrodes 85-88 contains Pd, and the green body with the electroconductive paste is fired to obtain the varistor element body 81 and the first electrode layers 85*a*-88*a*; therefore, the varistor element body 81 and the first electrode layers 85*a*-88*a* are simultaneously fired. This can achieve an improvement in the bonding strength between the varistor element body 81 and the external electrodes 85-88 (first electrode layers 85*a*-88*a*).

In the present second embodiment, as in the first embodiment, the electroconductive paste for formation of the first electrode layers 85*a*-88*a* contains no glass frit. For this reason, there occurs no degradation of plateability and solder wettability.

Next, configurations of modification examples of the multilayer chip varistor 71 according to the second embodiment will be described with reference to FIGS. 13 to 18. FIGS. 13 to 18 are views for explaining sectional configurations of the modification examples of the multilayer chip varistor according to the second embodiment. Each modification example is different in the shapes of the first internal electrodes 92 and second internal electrode layers 95 from the multilayer chip varistor 71 described above.

Figure 13:
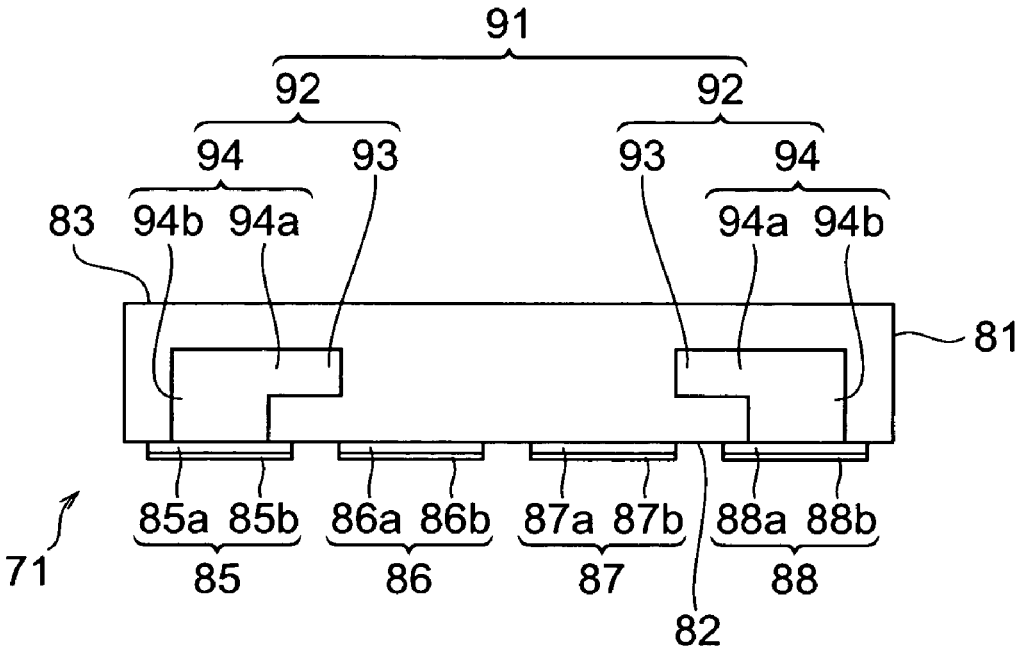
FIG. 13 is a view for explaining a sectional configuration of a modification example of the multilayer chip varistor according to the second embodiment.
Figure 14:
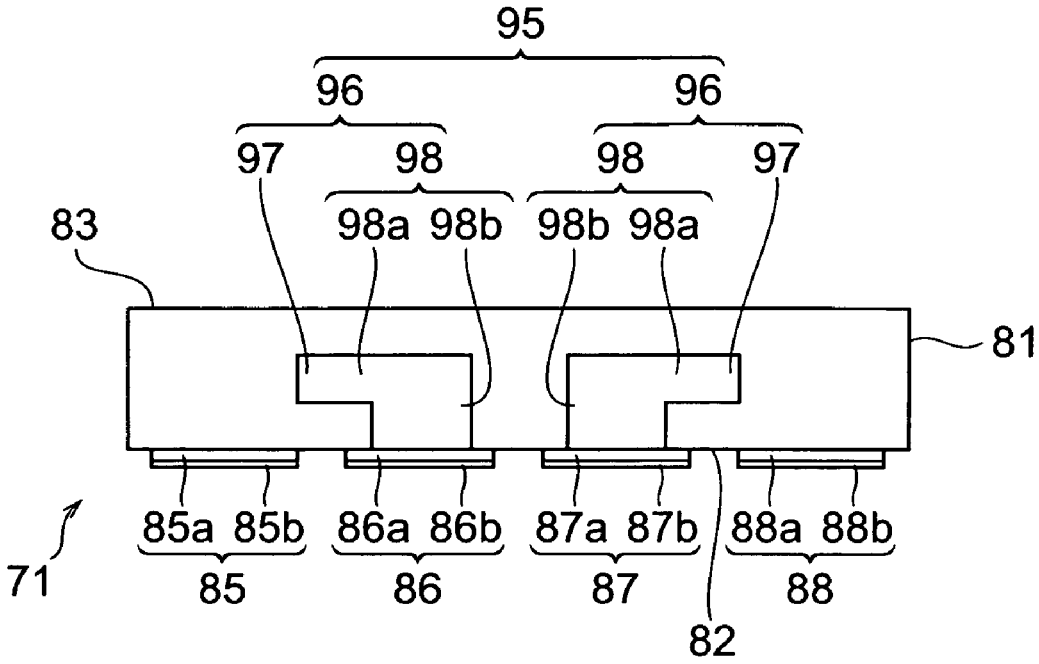
FIG. 14 is a view for explaining a sectional configuration of a modification example of the multilayer chip varistor according to the second embodiment.

In the modification example shown in FIGS. 13 and 14, the width of the second regions 94*b*, 98*b* of the second electrode portions 94, 98 is larger than the width of the first regions 94*a*, 98*a* of the second electrode portions 94, 98. This can reduce the equivalent series resistance (ESR) and equivalent series inductance (ESL) of the first internal electrodes 92 and the second internal electrode layers 95.

Figure 15:
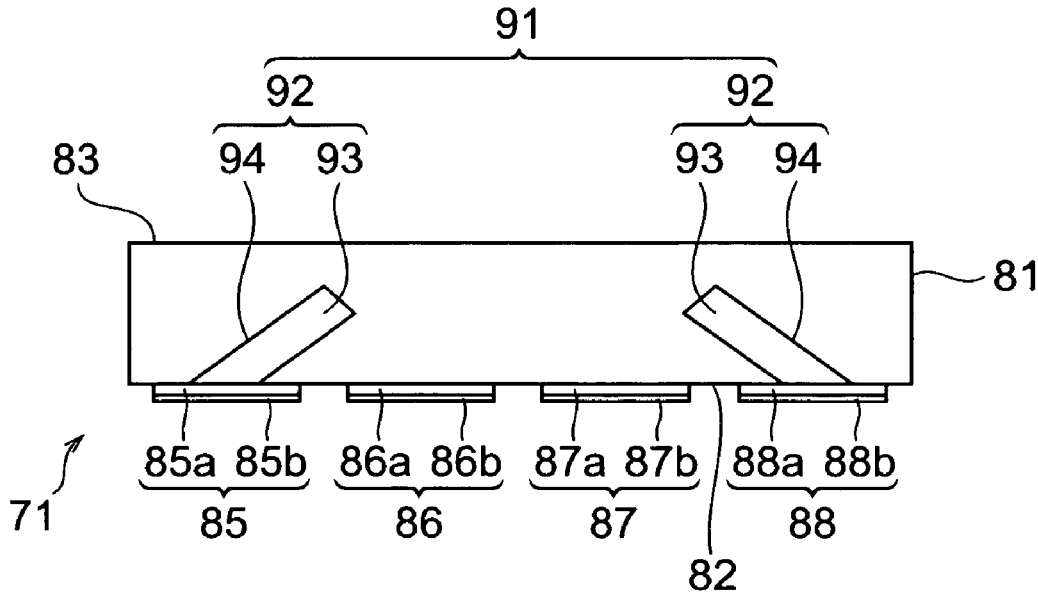
FIG. 15 is a view for explaining a sectional configuration of a modification example of the multilayer chip varistor according to the second embodiment.
Figure 16:
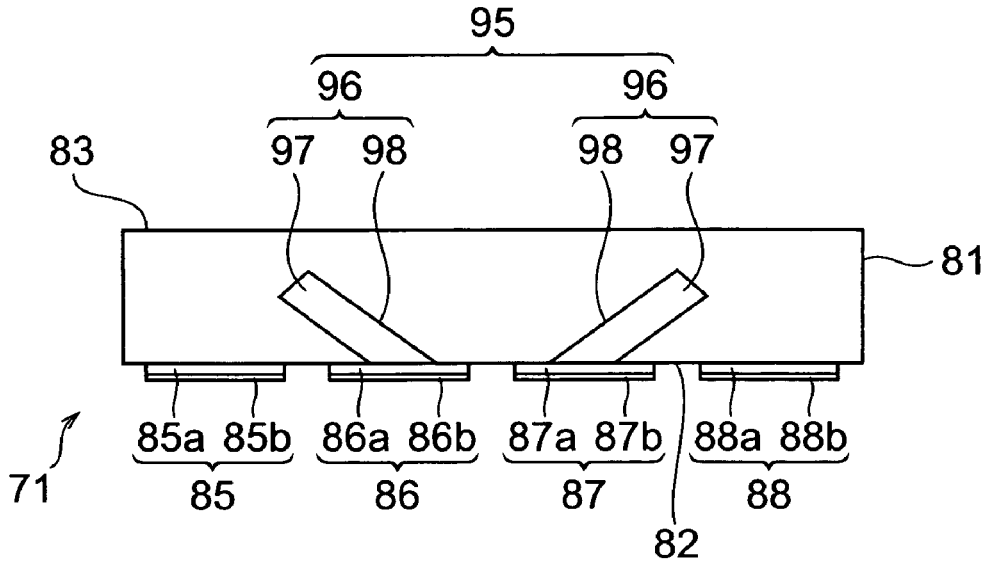
FIG. 16 is a view for explaining a sectional configuration of a modification example of the multilayer chip varistor according to the second embodiment.

In the modification example shown in FIGS. 15 and 16, the second electrode portions 94, 98 are linearly led from the first electrode portions 93, 97. In this case, the lengths of the second electrode portions 94, 98 are relatively short, and thus the ESR and ESL can be reduced.

Figure 17:
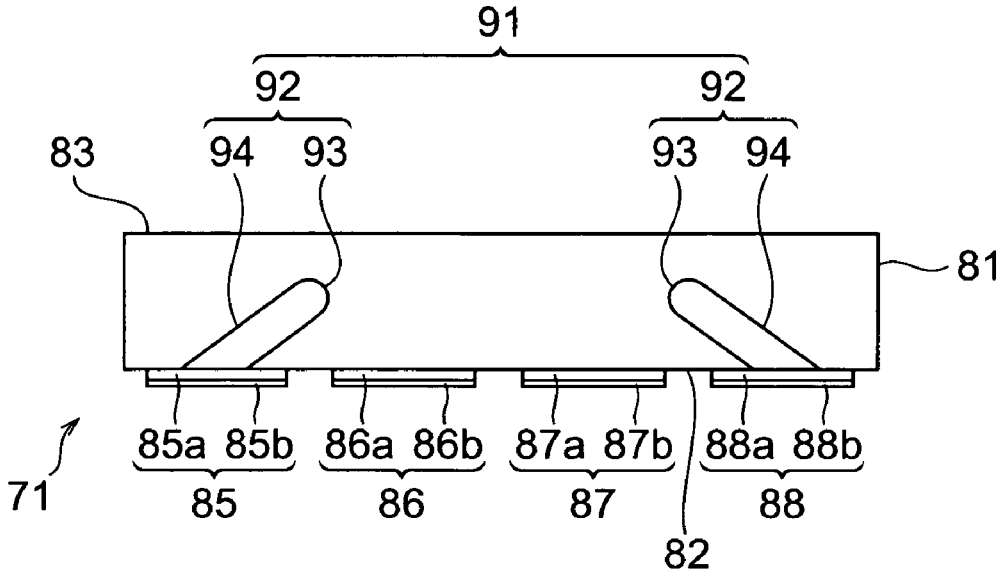
FIG. 17 is a view for explaining a sectional configuration of a modification example of the multilayer chip varistor according to the second embodiment.
Figure 18:
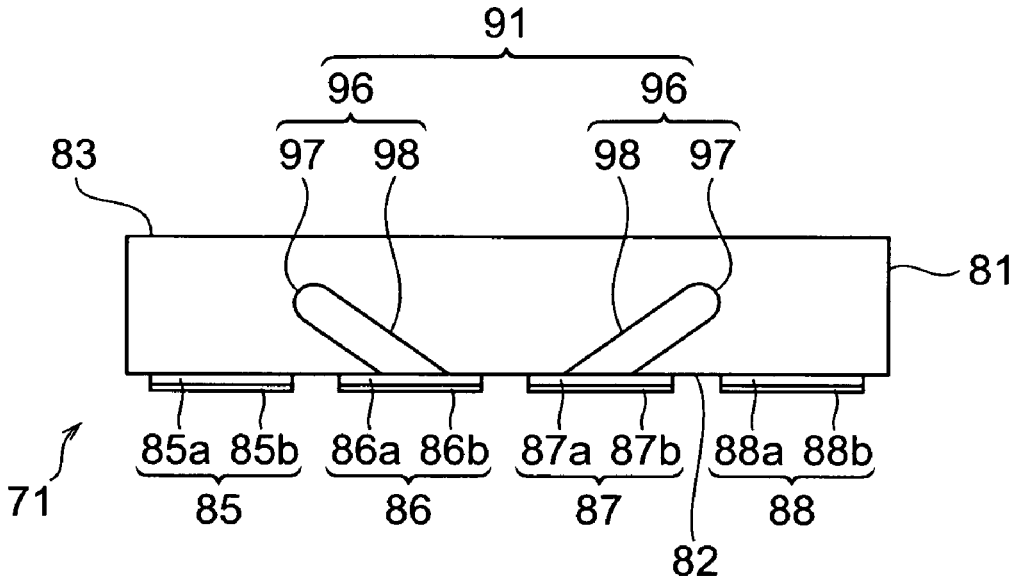
FIG. 18 is a view for explaining a sectional configuration of a modification example of the multilayer chip varistor according to the second embodiment.

In the modification example shown in FIGS. 17 and 18, the second electrode portions 94, 98 are linearly led from the first electrode portions 93, 97. In this case, the lengths of the second electrode portions 94, 98 are relatively short, and thus the ESR and ESL can be reduced Incidentally, when a surge voltage like ESD is applied to the multilayer chip varistor, an electric field distribution at the mutually overlapping portions of the internal electrodes is concentrated at ends of the mutually overlapping portions of the internal electrodes. If the mutually overlapping portions of the internal electrodes have corners, the electric field distribution is concentrated particularly at the corners, so as to cause a sudden drop of ESD resistance. In the modification example shown in FIGS. 17 and 18, the shape of the mutually overlapping portions of the first electrode portions 93 and the first electrode portions 97 is round. This suppresses the concentration of the electric field distribution at the mutually overlapping portions of the internal electrodes and thus prevents the drop of ESD resistance.

By rounding the corners of the first electrode portions 36, 38, 46*a*, 46*b*, 56, 58 shown in FIGS. 4 to 6 and the corners of the first electrode portions 93, 97 shown in FIGS. 11 to 16, it is also possible to suppress the concentration of the electric field distribution and to prevent the drop of ESD resistance. Furthermore, by rounding the corners of the second electrode portions 94, 98 shown in FIGS. 11 to 14, it is also possible to suppress the concentration of the electric field distribution and to prevent the drop of ESD resistance. The effect of suppressing the concentration of the electric field distribution is greater in the configuration in which the corners of the second electrode portions 94, 98 are rounded than in the configuration in which the corners of the first electrode portions 36, 38, 46*a*, 46*b*, 56, 58, 93, 97 are rounded.

In the multilayer chip varistors 11, 71 of the first and second embodiments, the varistor element body 21, 81 (varistor layers) does not contain Bi. The reason why the varistor element body 21, 81 does not contain Bi is as follows. If the varistor element body contains ZnO as a principal component and also contains Bi and if each external electrode has an electrode layer formed on the outer surface of the varistor element body by simultaneous firing with the varistor element body and containing Pd, the simultaneous firing of the electrode layer with the varistor element body will result in alloying Bi and Pd to form an alloy of Bi and Pd at the interface between the varistor element body and the electrode layer. The alloy of Bi and Pd has poor wettability, particularly, with the varistor element body, and acts to degrade the bonding strength between the varistor element body and the electrode layer. For this reason, it becomes difficult to secure the bonding strength in a desired state between the varistor element body and the electrode layer.

The preferred embodiments of the present invention were described above, but it is noted that the present invention is by no means limited to these embodiments. For example, the number of resistors 61, 63 is not limited to 10 described above, but may be 1 or 2 or more. In this case, the number of varistor portions and external electrodes 25-29, 30*a*-30*d* is a number corresponding to the number of resistors 61, 63.

In the aforementioned multilayer chip varistors 11, 71, each varistor portion has a pair of first electrode portions 36, 38, 46*a*, 46*b*, 56, 58, 93, 97 opposed on both sides of the varistor layer. Without having to be limited to this, each varistor portion may have plural pairs of first electrode portions 36, 38, 46*a*, 46*b*, 56, 58, 93, 97 opposed on both sides of the varistor layer.

In the aforementioned multilayer chip varistors 11, 71, the plurality of varistor portions are arranged along the laminate direction of the varistor layers and in the direction parallel to the varistor layers, but the present invention is not limited to this. A plurality of varistor portions may be arranged only in the laminate direction of the varistor layers. Alternatively, a plurality of varistor portions may be arranged only along the direction parallel to the varistor layers. The number of varistor portions arranged is not limited to the aforementioned numbers, either.

In the aforementioned multilayer chip varistor 11, other electric circuit elements such as inductors may also be mounted instead of the resistors 61, 63.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A multilayer chip varistor comprising:

a multilayer body in which a plurality of varistor portions are arranged along a predetermined direction, each of said varistor portions having a varistor layer to exhibit nonlinear voltage-current characteristics and a plurality of internal electrodes disposed so as to interpose the varistor layer between the internal electrodes; and a plurality of terminal electrodes disposed on a first outer surface of the multilayer body, wherein the first outer surface extends in a direction parallel to the predetermined direction; a plurality of pad electrodes disposed on a first outer surface of the multilayer body, facing the first outer surface, and a resistor disposed on the second outer surface wherein each of the plurality of internal electrodes comprises:

a first electrode portion overlapping with another first electrode portion between adjacent internal electrodes in a laminate direction of the multilayer body out of the plurality of internal electrodes; and a second electrode portion led from the first electrode portion so as to be exposed in the first outer surface, wherein one terminal electrode out of the plurality of terminal electrodes is electrically connected via the second electrode portion to one internal electrode out of said adjacent internal electrodes in the laminate direction, and another terminal electrode out of the plurality of terminal electrodes is electrically connected via the second electrode portion to another internal electrode out of said adjacent internal electrodes in the laminate direction, the second electrode portion of one internal electrode out of said adjacent internal electrodes is led so as to be exposed in the second outer surface and each of the plurality of pad electrodes is electrically connected via the second electrode portion to said one internal electrode corresponding thereto, and the resistor disposed on the second outer surface is electrically connected to a pair of pad electrodes out of the plurality of pad electrodes.

2. The multilayer chip varistor according to claim 1, wherein the multilayer body is of a plate shape having the first outer surface and the second outer surface as principal surfaces, and wherein a distance between the first outer surface and the second outer surface is smaller than a length of the multilayer body in the predetermined direction.

3. The multilayer chip varistor according to claim 1, wherein the predetermined direction is a laminate direction of the varistor layers.

4. The multilayer chip varistor according to claim 1, wherein the predetermined direction is a direction parallel to the varistor layers.

5. The multilayer chip varistor according to claim 1, wherein the plurality of terminal electrodes are two-dimensionally arrayed on the first outer surface.

6. The multilayer chip varistor according to claim 1, wherein the second electrode portion is linearly led from the first electrode portion.

7. The multilayer chip varistor according to claim 1, wherein the second electrode portion comprises:

a first region extending from the first electrode portion in a direction normal to a facing direction of the first outer surface and a second outer surface of the multilayer body facing the first outer surface and normal to the laminate direction of the varistor layers; and a second region extending from the first region in the facing direction of the first outer surface and the second outer surface, and wherein a length of the second region in the direction normal to the facing direction of the first outer surface and the second outer surface and normal to the laminate direction of the varistor layers is larger than a length of the first region in the facing direction of the first outer surface and the second outer surface.

8. The multilayer chip varistor according to claim 1, wherein the varistor layer comprises ZnO as a principal component, and a rare-earth metal, and wherein each of the plurality of terminal electrodes has an electrode layer formed on the first outer surface by simultaneous firing with the varistor layer, and comprising Pd.

9. The multilayer chip varistor according to claim 8, wherein the rare-earth metal in the varistor layer is Pr.

10. The multilayer chip varistor according to claim 1, wherein the varistor layer comprises ZnO as a principal component, and a rare-earth metal, wherein each of the plurality of terminal electrodes has an electrode layer disposed on the first outer surface and comprising Pd, and wherein a compound of the rare-earth metal in the varistor layer and Pd in the electrode layer exists near an interface between the multilayer body and each of said terminal electrodes.

11. The multilayer chip varistor according to claim 10, wherein the electrode layer is formed on the first outer surface by simultaneous firing with the varistor layer.

12. The multilayer chip varistor according to claim 10, wherein the rare-earth metal in the varistor layer is Pr.

13. A multilayer chip varistor comprising:

a multilayer body in which a plurality of varistor layers to exhibit nonlinear voltage-current characteristics are laminated;

a plurality of terminal electrodes disposed on a first outer surface of the multilayer body, wherein the first outer surface extends in a direction parallel to a laminate direction of the plurality of varistor layers, and wherein in the multilayer body, a plurality of varistor portions, each having the varistor layer and a plurality of internal electrodes disposed so as to interpose the varistor layer between the internal electrodes, are arranged along a direction parallel to the first outer surface, a plurality of pad electrodes disposed on a first outer surface of the multilayer body, facing the first outer surface, and a resistor disposed on the second outer surface, wherein each of the plurality of internal electrodes comprises:

a first electrode portion overlapping with another first electrode portion between adjacent internal electrodes in a laminate direction of the multilayer body out of the plurality of internal electrodes; and a second electrode portion led from the first electrode portion so as to be exposed in the first outer surface, wherein one terminal electrode out of the plurality of terminal electrodes is electrically connected via the second electrode portion to one internal electrode out of said adjacent internal electrodes in the laminate direction, and another terminal electrode out of the plurality of terminal electrodes is electrically connected via the second electrode portion to another internal electrode out of said adjacent internal electrodes in the laminate direction, the second electrode portion of one internal electrode out of said adjacent internal electrodes is led so as to be exposed in the second outer surface and each of the plurality of pad electrodes is electrically connected via the second electrode portion to said one internal electrode corresponding thereto, and the resistor disposed on the second outer surface is electrically connected to a pair of pad electrodes out of the plurality of pad electrodes.

* * * * *